US007947134B2

(12) United States Patent
Lohwongwatana et al.

(10) Patent No.: US 7,947,134 B2
(45) Date of Patent: May 24, 2011

(54) PROCESS FOR JOINING MATERIALS USING BULK METALLIC GLASSES

(75) Inventors: Boonrat Lohwongwatana, Bangkok (TH); Robert D. Conner, Oak Hills, CA (US); Jin-Yoo Suh, Pasadena, CA (US); William L. Johnson, Pasadena, CA (US); Daewoong Suh, Chandler, AZ (US)

(73) Assignee: California Institute of Technology, Pasadena, CA (US)

( * ) Notice: Subject to any disclaimer, the term of this patent is extended or adjusted under 35 U.S.C. 154(b) by 509 days.

(21) Appl. No.: 12/062,941

(22) Filed: Apr. 4, 2008

(65) Prior Publication Data

US 2008/0251164 A1 Oct. 16, 2008

Related U.S. Application Data

(60) Provisional application No. 60/921,807, filed on Apr. 4, 2007, provisional application No. 60/921,805, filed on Apr. 4, 2007.

(51) Int. Cl.
*C22F 1/08* (2006.01)
*C22F 1/14* (2006.01)

(52) U.S. Cl. ..... 148/522; 148/561

(58) Field of Classification Search ..... None
See application file for complete search history.

(56) References Cited

U.S. PATENT DOCUMENTS

| | | | | |
|---|---|---|---|---|
| 4,070,197 | A | 1/1978 | Coes | |
| 5,288,344 | A | 2/1994 | Peker et al. | |
| 5,368,659 | A | 11/1994 | Peker et al. | |
| 5,482,580 | A | 1/1996 | Scruggs et al. | |
| 5,618,359 | A | 4/1997 | Lin et al. | |
| 5,735,975 | A | 4/1998 | Lin et al. | |
| 6,485,589 | B1 | 11/2002 | Johnson et al. | |
| 6,709,536 | B1 | 3/2004 | Kim et al. | |
| 6,818,078 | B2 | 11/2004 | Kim et al. | |
| 2004/0154165 | A1 * | 8/2004 | Takoshima et al. | 29/846 |
| 2007/0023489 | A1 | 2/2007 | Swiston et al. | |
| 2007/0068648 | A1 * | 3/2007 | Hu et al. | 164/92.1 |

FOREIGN PATENT DOCUMENTS

JP 2001303218 10/2001

OTHER PUBLICATIONS

Shen et al., "Bulky Glassy $Co_{43}Fe_{20}Ta_{5.5}B_{31.5}$ Alloy with High Glass-Forming Ability and Good Soft Magnetic Properties", Source Unknown, Jun. 12, 2001, pp. 2136-2139.
Inoue et al., "Formation, Thermal Stability and Mechanical Properties of Cu-Zr-Al Bulk Glassy Alloys", Materials Transactions, 2002, vol. 43, No. 11, pp. 2922-2925.
Johnson et al., "Structure and properties of transition-metal-metalloid glasses based on refractory metals", Physical Review B, Aug. 15, 1979, vol. 20, No. 4, pp. 1640-1655.
Johnson, "Bulk Glass-Forming Metallic Alloys: Science and Technology", MRS Bulletin, Oct. 1999, pp. 42-56.

(Continued)

*Primary Examiner* — George Wyszomierski
(74) *Attorney, Agent, or Firm* — Kauth, Pomeroy, Peck & Bailey LLP

(57) ABSTRACT

Methods and compositions for a novel metal-to-metal or material-to-material joining technique using bulk metallic glasses are provided. The method of the current invention relies on the superior mechanical properties of bulk metallic glasses and/or softening behavior of metallic glasses in the undercooled liquid region of temperature-time process space, enabling joining of a variety of materials at a much lower temperature than typical ranges used for soldering, brazing or welding.

25 Claims, 13 Drawing Sheets

OTHER PUBLICATIONS

Suh et al., "Flow and Fracture in Zr-Based Bulk Metallic Glasses", Ann. Chim. Sci. Mat., 2002, vol. 27 No. 5, pp. 25-40.
Inoue et al., "Bulky La-Al-TM (TM=Transition Metal) Amorphous Alloys with High Tensile Strength Produced by a High-Pressure Die Casting Method", Materials Transactions, JIM, 1993, vol. 34, No. 4, pp. 351-358.
Inoue et al., "Al-Ni-Y-Co Amorphous Alloys with High Mechanical Strengths, Wide Supercooled Liquid Region and Large Glass-Forming Capacity", Materials Transactions, JIM, 1990, vol. 31, No. 6 pp. 493-500.
Inoue et al., "Al-La-Cu Amorphous Alloys with a Wide Supercooled Liquid Region", Materials Transactions, JIM, 1990, vol. 31, No. 2, pp. 104-109.
Inoue et al., "Al-La-Ni Amorphous Alloys with a Wide Supercooled Liquid Region", Materials Transactions, JIM, 1989, vol. 30, vol. 12, pp. 965-972.
Inoue et al., "Mg-Cu-Y Bulk Amorphous Alloys with High Tensile Strength Produced by High-Pressure Die Casting Method", Materials Transactions, JIM, 1992, vol. 33, No. 10, pp. 937-945.
Inoue et al., "Effect of Additional Elements on Glass Transition Behavior and Glass Formation Tendency of Zr-Al-Cu-Ni Alloys", Materials Transactions, JIM, 1995, vol. 36, No. 12, pp. 1420-1426.
Inoue et al., "Preparation of Bulk Glassy $Pd_{40}Ni_{10}Cu_{30}P_{20}$ Alloy of 40 mm in Diameter by Water Quenching", Materials Transactions, JIM, 1996, vol. 37, No. 2, pp. 181-184.
Zhang et al., "Thermal and Mechanical Properties of Ti-Ni-Cu-Sn Amorphous Alloys with a Wide Supercooled Liquid Region before Crystallization", Materials Transactions, JIM, 1990, vol. 39, No. 10, pp. 1001-1006.
Xi et al., "Fracture of Brittle Metallic Glasses: Brittleness or Plasticity", Physical Review Letters, Apr. 1, 2005, vol. 94, pp. 125510-1-125501-4.
Li et al., "Effects of Sb addition on tensile strength of Sn-3.5Ag-0.7Cu solder alloy and join", Thin Solid Films, 2006, vol. 504, pp. 421-425.
Ren et al., "Electromigration induced ductile-to-brittle transition in lead-free solder joints", Applied Physics Letters, 2006, vol. 89, pp. 141914-1-141914-3.
Ohmura et al., "Coherent Control of Photofragment Separation in the Dissociative Ionization of IBr", Physical Review Letters, Mar. 19, 2004, vol. 92, No. 11, pp. 113002-1-113002-4.
Lin et al., "Formation of Ti-Zr-Cu-Ni bulk metallic glasses", J. Appl. Phys., Dec. 1, 1995, vol. 78, No. 11, pp. 6514-6519.
Inoue, "Stabilization of Metallic Supercooled Liquid and Bulk Amorphous Alloys", Acta mater., 2000, vol. 48, pp. 279-306.
Kawase et al., "Crystallization on supercooled liquid in metallic Zr-Cu-Al glasses", Appl. Phys. Lett., Jan. 11, 1993, vol. 62, No. 2, pp. 137-139.
Xu et al., "Unusual Glass-Forming Ability of Bulk Amorphous Alloys Based on Ordinary Metal Copper", Physical Review Letters, Jun. 18, 2004, vol. 92, No. 24, pp. 245504-1-245504-4.
Inoue et al., "Bulk amorphous alloys with high mechanical strength and good soft magnetic properties in Fe-TM-B (TM=IV-VIII group transition metal) system", Appl. Phys. Lett., Jul. 28, 1997, vol. 71, No. 4, pp. 464-466.
Lee et al., "Synthesis of Ni-based bulk amorphous alloys by warm extrusion of amorphous powders", Journal of Non-Crystalline Solids, 2003, vol. 315, pp. 89-96.
Choi-Yim et al., "Ni-based bulk metallic glass formation in the Ni-Nb-Sn and Ni-Nb-Sn-X (X=B, Fe, Cu) alloy systems", Applied Physics Letters, Feb. 17, 2003, vol. 82, No. 7, pp. 1030-1032.
Inoue et al., "Wide supercooled liquid region and soft magnetic properties of $Fe_{56}Co_7Ni_7Zr_{0-10}Nb$ (or$Ta)_{0-10}B_{20}$ amorphous alloys", Journal of Applied Physics, Feb. 15, 1998, vol. 83, No. 4, pp. 1967-1974.
Inoue et al., "New bulk amorphous Fe-(Co,Ni)-M-B (M=Zr,Hf,Nb,Ta,Mo,W) alloys with good soft magnetic properties", Journal of Applied Physics, Jun. 1, 1998, vol. 83, No. 11, pp. 6326-6328.
Park et al., "Formation of Ca-Mg-Zn bulk glassy alloy by casting into cone-shaped copper mold", J. Mater. Res., Mar. 2004, vol. 19, No. 3, pp. 685-688.
Guo et al., "Formation of ductile Al-based metallic glasses without rare-earth elements", Philosophical Magazine Letters, 2001, vol. 81, No. 3, pp. 203-211.
Zhang et al., ""Soft" bulk metallic glasses based on cerium", Applied Physics Letters, Jul. 5, 2004, vol. 85, No. 1, pp. 61-63.
Zhang et al., "Glass-forming ability and crystallization behavior of $Nd_{60}Al_{10}Ni_{10}Cu_{20}$-$xFe_x$ (x= 0, 2, 4) bulk metallic glass with distinct glass transition", Materials Science and Engineering A, 2004, vol. 385, pp. 38-43.
Lee et al., "Spheres of the metallic glass $Au_{55}Pb_{22.5}Sb_{22.5}$ and their surface characteristics", Appl. Phys. Lett., Mar. 1, 1982, vol. 40, No. 5, pp. 382-384.
Dyson et al., "Interstitial Diffusion of Copper in Tin", http://jap.aip.org/jap/copyright.jsp., Apr. 3, 1967, pp. 3408-3409.
Drehman et al., "Bulk formation of a metallic glass: $Pd_{40}Ni_{40}P_{20}$", Appl. Phys. Lett., Oct. 15, 1982, vol. 41, No. 8, pp. 716-717.
Chen et al., "Evidence of a Glass-Liquid Transition in a Gold-Germanium-Silicon Alloy", http://jcp.aip.org/jcp/copyright.jsp., Nov. 2, 1967, pp. 2560-2571.
Schroers, "The Superplastic Forming of Bulk Metallic Glasses", JOM, May 2005, pp. 35-39.
Schroers, "Highly processable bulk metallic glass-forming alloys in the Pt-Co-Ni-Cu-P system", Applied Physics Letters, May 3, 2004, vol. 84, No. 18, pp. 3666-3668.
Hays et al., "Microstructure Controlled Shear Band Pattern Formation and Enhanced Plasticity of Bulk Metallic Glasses Containing in situ Formed Ductile Phase Dendrite Dispersions", Physical Review Letters, Mar. 27, 2000, vol. 84, No. 13, pp. 2901-2904.
Klement et al., "Non-crystalline Structure in Solidified Gold-Silicon Alloys", Nature, Sep. 3, 1960, vol. 187, No. 4740, pp. 869-870.
Greer, "Metallic Glasses", Science, Mar. 31, 1995, vol. 267, No. 5206, pp. 1947-1953.
International Search Report for PCT/US2008/059453, Report completed Aug. 10, 2008, Report mailed Aug. 15, 2008, 2 pgs.
Busch et al., "Decomposition and primary crystallization in undercooled $Zr_{41.2}Ti_{13.8}Cu_{12.5}Ni_{10.0}Be_{22.5}$ melts", Apply. Phys. Lett., Sep. 11, 1995, vol. 67, No. 11, pp. 1544-1546.

* cited by examiner

FIG. 10

| | 1<br>IA<br>1A | 2<br>IIA<br>2A | Groups | | | | | | | | | | 13<br>IIIA<br>3A | 14<br>IVA<br>4A | 15<br>VA<br>5A | 16<br>VIA<br>6A |
|---|---|---|---|---|---|---|---|---|---|---|---|---|---|---|---|---|
| 1 | | | | | | | | | | | | | | | | |
| 2 | 3<br>Li<br>6.941 | 4<br>9.012 | | | | | | | | | | | 5<br>10.81 | 6<br>12.01 | | |
| 3 | 11<br>Na<br>22.99 | 12<br>24.31 | 3<br>IIIB<br>3B | 4<br>IVB<br>4B | 5<br>VB<br>5B | 6<br>VIB<br>6B | 7<br>VIIB<br>7B | 8<br>---- | 9<br>VIIIB<br>-<br>----- 8 ----- | 10<br>--- | 11<br>IB<br>1B | 12<br>IIB<br>2B | 13<br>26.98 | 14<br>28.09 | 15<br>30.97 | 16<br>S<br>32.07 |
| 4 | 19<br>K<br>39.10 | 20<br>40.08 | 21<br>44.96 | 22<br>47.88 | 23<br>50.94 | 24<br>52.00 | 25<br>54.94 | 26<br>55.85 | 27<br>58.47 | 28<br>58.69 | 29<br>63.55 | 30<br>65.39 | 31<br>69.72 | 32<br>72.59 | | |
| 5 | 37<br>Rb<br>85.47 | 38<br>87.62 | 39<br>88.91 | 40<br>91.22 | 41<br>92.91 | 42<br>95.94 | | 44<br>101.1 | 45<br>102.9 | 46<br>106.4 | 47<br>107.9 | 48<br>112.4 | 49<br>114.8 | 50<br>118.7 | 51<br>121.8 | |
| 6 | | 56<br>137.3 | 57<br>*<br>138.9 | 72<br>178.5 | 73<br>180.9 | 74<br>183.9 | 75<br>186.2 | 76<br>190.2 | 77<br>190.2 | 78<br>195.1 | 79<br>197.0 | 80<br>200.5 | 81<br>204.4 | 82<br>207.2 | 83<br>209.0 | 84<br>(210) |

| | | | | | | | | | | | | | | |
|---|---|---|---|---|---|---|---|---|---|---|---|---|---|---|
| Lanthanide Series* | 58<br>Ce<br>140.1 | 59<br>Pr<br>140.9 | 60<br>Nd<br>144.2 | 61<br>Pm<br>(147) | 62<br>Sm<br>150.4 | 63<br>Eu<br>152.0 | 64<br>Gd<br>157.3 | 65<br>Tb<br>158.9 | 66<br>Dy<br>162.5 | 67<br>Ho<br>164.9 | 68<br>Er<br>167.3 | 69<br>Tm<br>168.9 | 70<br>Yb<br>173.0 | 71<br>Lu<br>175.0 |

PROCESS FOR JOINING MATERIALS USING BULK METALLIC GLASSES

CROSS-REFERENCE TO RELATED APPLICATIONS

The current application claims priority to U.S. Provisional Application Nos. 60/921,807, filed Apr. 4, 2007 and 60/921,805, filed Apr. 4, 2007, the disclosures of which are incorporated herein by reference.

FIELD OF THE INVENTION

The current invention is directed to processes for joining materials together utilizing bulk metallic glasses; and more particularly to processes for joining materials at low temperature utilizing such bulk metallic glasses.

BACKGROUND OF THE INVENTION

Lead (Pb) is widely recognized as a toxic substance, and the health and environmental issues related to the use of lead have been well documented over many decades. Lead poisoning is a serious health threat which usually occurs after a prolong exposure to lead and lead compounds. As a result, in the United States, the use of lead and lead compounds has already been banned from many consumer products. For example, tetraethyl-lead was formerly used as an "anti-knock" additive in gasoline, lead solder was used in plumbing applications, and of course in past decades lead was commonly found in paint.

Despite the concerted efforts of a number of different industries to eliminate the use of lead, it is still found in many consumer goods, including storage batteries, ammunition and electronic products. While storage batteries account for approximately 80% of lead consumption, its recycling program is very effective and therefore raises few health concerns. However, lead solder usage in electronic materials is of particular concern because these devices are rarely recycled resulting in the contamination of landfills when the products are discarded. More alarmingly, once in the landfill lead solder from electronic circuit boards can leach into the ground water system and also contaminate the soil.

Many countries around the world have taken steps to eliminate lead contamination from electronic products over the past two decades. The global electronic industry is under a lot of pressure from the European Union (EU) to completely phase out lead from many electronic products. Specifically, the EU enacted the directive called ROHS (Official Journal of the European Union, L37 19-23, Feb. 13, 2003,), or the Restriction of Hazardous Substances, which as of Jul. 1, 2006, banned lead (and a few other hazardous substances) from most consumer electronic products. Many countries in Asia including China, Korea, and Japan have come up with their own version of ROHS legislation. In the US, California's SB20 prohibits the sale of electronic devices which are prohibited under the EU's ROHS after Jan. 1, 2007.

As a result, there has been an ongoing research effort to find a substitute for Pb solder, but, until now, there has been no clear solution to the problem. In the current transition stage, the commercial Pb-free solders for reflow application in electronics packaging include a few varieties of near ternary eutectic of tin (Sn), silver (Ag) and/or copper (Cu) alloys with possible minute additions of elements such as bismuth (Bi), indium (In), zinc (Zn), and antimony (Sb). However, these Sn—Ag—Cu (SAC) and Sn—Ag-Bi (SAB) solders are only band-aid solutions to comply with ROHS. SAC solders are inferior to Pb-Sn solder in terms of solderability (wetting, spreading and low melting) and reliability. Each of these technical drawbacks can limit the effectiveness and applicability of these materials. For example, higher processing temperatures create a serious problem in a system with multiple joining processes, such as flip-chip packaging. The temperature of the last reflow process dictates the temperature of prior reflow processes. Specifically, in the case of electronics, replacing the traditional Pb-Sn solder with Sn—Ag raises the soldering temperature from 180° C. to 215-250° C. This in turn elevates the required melting temperature of prior reflow processes to above the 300° C. range to avoid subsequent remelting. Unfortunately, there are only a limited number of solders that satisfy these conditions. Moreover, there are other potential problems regarding the stability of substrates and other features on the chip that are not designed to withstand processing at these higher temperatures.

Likewise, molten lead has a very low surface tension, which contributes to its excellent wettability and spreading. Indeed, it has long been observed that the wetting characteristic of Pb/Sn solder far exceeds those of lead-free alternatives. At the interconnect interface, Pb/Sn solder forms chemical bond by creating a stable pure Sn compound. The replacement SAC solders would have three competing phases competing: β—Sn, $Ag_3Sn$ and $Cu_6Sn_5$. The two latter phases are non-equilibrium intermetallic compounds, which nucleate and grow with minimal undercooling. Adequate undercoating usually translates to the reduction of residual stresses. There are numerous studies showing the poor mechanical, thermal and electrical reliability of these two intermetallics.

Specifically, mechanical connection, electrical conduction and thermal pathway are three main functions of solder joints, particularly in the electronics industry. Mechanical attachment problems usually stem from the mismatch of the coefficients of thermal expansion between the materials attached to both ends of the solder joints and mismatch between the solder joint and attached substrate materials. During thermal cycling, the joint experiences shear stresses. Pb-solder joints release thermally induced stress by plastic deformation, which is not possible with SAC solder. For example, FIG. 1 provides a micrograph of a failed SAC solder joint after subjected to temperature cycling. Another shortcoming of SAC solder is electromigration with operation at high current density, as shown in FIG. 2. Because of the flaws of most of the current viable Pb-free solders, a direct and suitable replacement for traditional Pb-Sn soldering has not been found.

SUMMARY OF THE INVENTION

The current invention is directed to methods for joining materials at low temperature using bulk metallic glasses.

BRIEF DESCRIPTION OF THE DRAWINGS

The description will be more fully understood with reference to the following figures and data graphs, which are presented as exemplary embodiments of the invention and should not be construed as a complete recitation of the scope of the invention, wherein:

FIG. 10 provides a truncated periodic table for quick reference of metals to be used in amorphous materials for use in the current invention;

DETAILED DISCLOSURE OF THE INVENTION

The current invention is directed to methods and compositions for a novel metal-to-metal or material-to-material joining technique using bulk metallic glasses. The method of the current invention relies on the superior mechanical properties of bulk metallic glasses and/or softening behavior of metallic glasses in the undercooled liquid region of temperature-time process space, enabling joining of a variety of materials at a much lower temperature than typical ranges used for soldering, brazing or welding. For example, by selection of the appropriate bulk metallic glasses can be used in the semiconductor industry, e.g., copper, copper-aluminum, gold, to allow for the replacement of lead and lead alloy solders.

A bulk metallic glass (BMG), also referred to as an amorphous alloy or a metallic glass, is a new class of metallic material that does not have crystalline structure. Various alloy families of BMG have been discovered during the past two decades. Overview of bulk metallic glasses and their properties could be found in a number of references, including, W. L. Johnson, MRS Bull. 24(10), 42 (19991); A. Inoue, Acta Materialia 48, 279-306 (2000); and A. L. Greer, Science 267, 1947-1953 (1995), the disclosures of which are incorporated herein by reference. One of the important characteristics of BMGs is that they may be processed like plastics or conventional silicate glasses when heated above their glass transition temperature, Tg. It has now been discovered that these properties allow the viscous BMG liquid to be used as a low temperature replacement for conventional joining materials, such as, for example, Pb-Sn and Sn-based solders. More specifically, the current invention recognizes that using bulk metallic glasses it is possible to join materials together at low temperatures and with high reliability by maintaining specific heating and cooling profiles for the BMG materials during the joining process.

Figure 1:
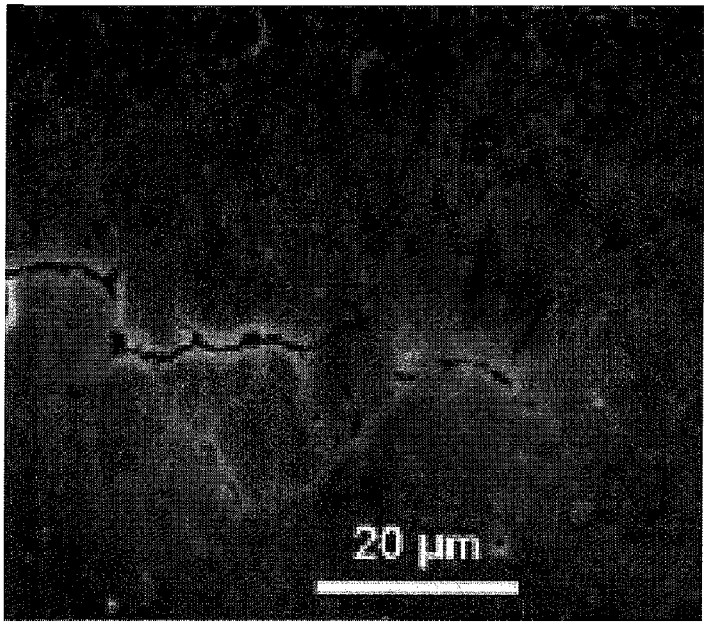
FIG. 1 provides a micrograph reproduction of a study showing the mechanical failure of a conventional SAC solder.
Figure 2:
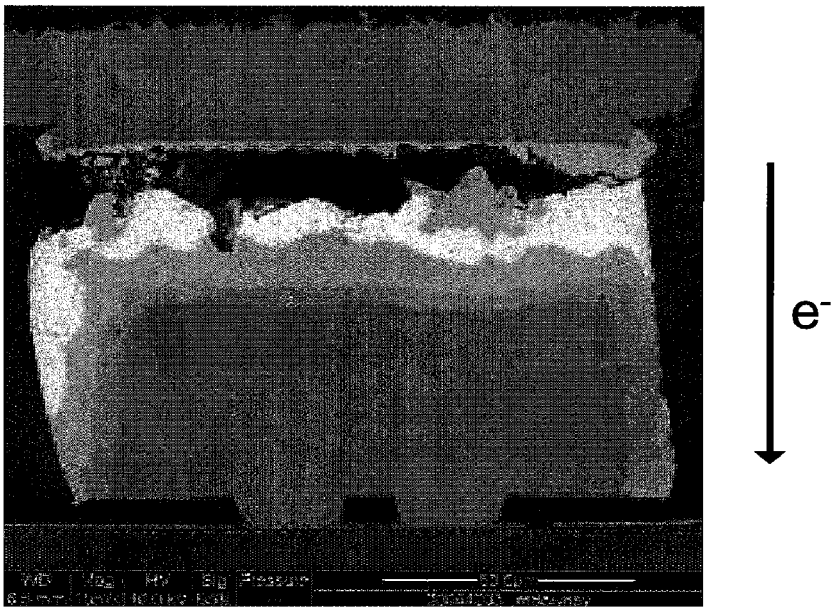
FIG. 2 provides a micrograph reproduction of a study showing solder electromigration failure of a conventional solder.
Figure 3:
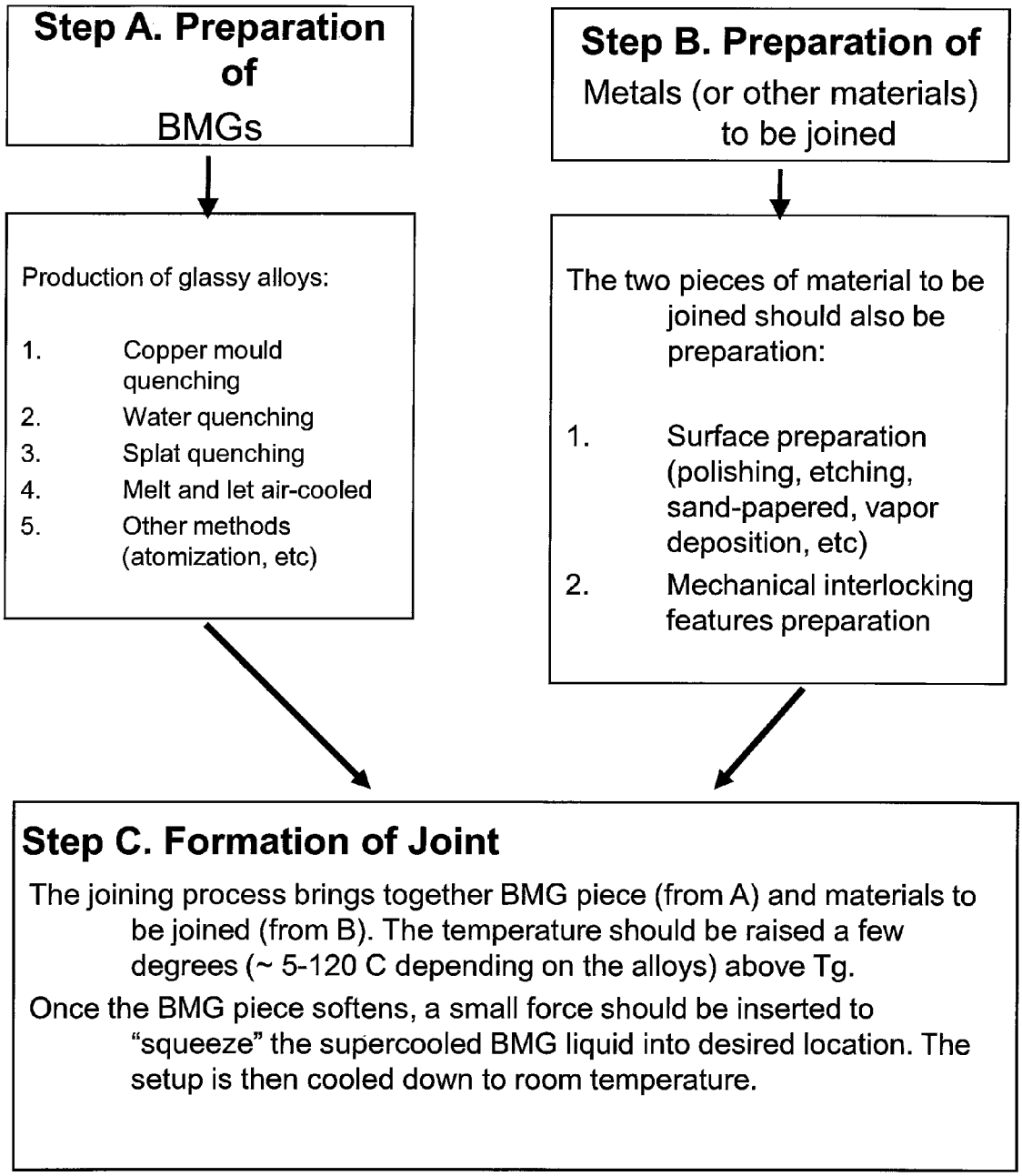
FIG. 3 provides a flowchart of a generic joint formation process in accordance with the current invention.

The flowchart of the basic joining process in accordance with the current invention is set forth in FIG. 3. As shown the process entails three basic process steps the preparation of the amorphous alloy joining material (Step A), the preparation of the materials to be joined (Step B), and then the formation of the joint. In terms of Steps A and B, it should be understood that any preparation capable of producing a suitable amorphous joining material and suitable interface surfaces to be joined can be used with the current invention. For example, the BMG may be formed by copper mould quenching, water quenching, splat quenching, melt and let air-cooled, or other suitable methods, such as, for example, (atomization, etc). Each of these processes will be described in greater detail below.

- In the copper mould quenching process the BMG is formed into thin strips. In such an embodiment the BMG solder strip can then be cut into a specific geometry for joining. The moulded pieces can then be placed on top of copper slug and cleaning agent prior to joining.
- During water quenching a BMG is melted and forced through a quartz tube nozzle to form small amorphous granules or "bebes". The molten alloy is then immediately water quenched. In such a preparation method the ejecting pressure and nozzle size can be altered to achieve amorphous alloy bebes of preferred sizes.
- In a splat-quenching method, the sample may be prepared by using Buehler's splat quencher. In such an embodiment the alloy becomes fully amorphous after being melted into spherical liquid and suddenly splatted by two high-speed copper anvils.
- For BMGs that have good glass forming properties it is possible to form a precursor using an arc-melter. In such an embodiment the BMG can be arc-melted and then air-cooled inside the arc-melter. The amorphous balls thus formed can then be melted in a mini-arc melter such that they become spherical and glassy.

Although the above-discussion has focused on some preferred methods for preparing the amorphous joining materials prior to forming the joint, it should be understood that any process capable of producing a suitable joining material precursor may be used, such as, for example, atomization, etc.

Turning to preparation of the materials to be joined (Step B in FIG. 3) it should be understood again that any suitable preparation method may be used. More specifically there are surface preparation techniques that are designed to create an interface having properties desirable for forming as strong a joint as possible, and then there are surface preparation techniques designed to form structures that can enhance the strength of the joint itself. For example, with regard to surface preparation techniques the any technique suitable for forming an interface surface having the desired properties for forming a joint can be used such as polishing, etching, sand-papered, coated via vapor deposition, etc. Likewise, as will be discussed further, the surfaces to be joined may be prepared with mechanical interlocking features.

Finally, once the joining material and the materials to be joined are sufficiently prepared the joint itself is formed as shown by Step C in FIG. 3. Generally, the joint formation process in accordance with the current invention requires an application of heat to allow the joint material to reach a temperature profile suitable for bonding the interface surfaces of the pieces to be joined, and a suitable pressure has to be applied to bring the interface surfaces together to form the joint in question. However, there are many different ways of applying heat and pressure that can be used in accordance with the amorphous joint formation process of the current invention. Exemplary amorphous joining processes in accordance with the current invention can be understood with reference to the continuous cooling transformation (CCT) schematic provided in FIG. 4. For clarity, the dashed region in FIG. 4 represents the solid phase while both crystalline and supercooled liquid occupy the upper portion of the diagram.

Description of Thermoplastic Joining Process

In a first exemplary joining methodology, a thermoplastic joining process is described. This "thermoplastic joining" process is based on the unique rheological behavior and pattern-replication ability of Bulk Metallic Glass. More specifically, the method relies on three unique properties of these materials: that an amorphous solid BMG specimen may be processed as a thermoplastic when heated above its glass transition temperature (Tg), that the Tg of these BMGs is typically substantially below the melting temperature (Tm) of the material, and that the viscosity of these BMG materials continues to decrease with increasing temperature. The temperature profile of the thermoplastic joining process is labeled as "Method 1" in temperature curve shown in FIG. 4.

Figure 4:
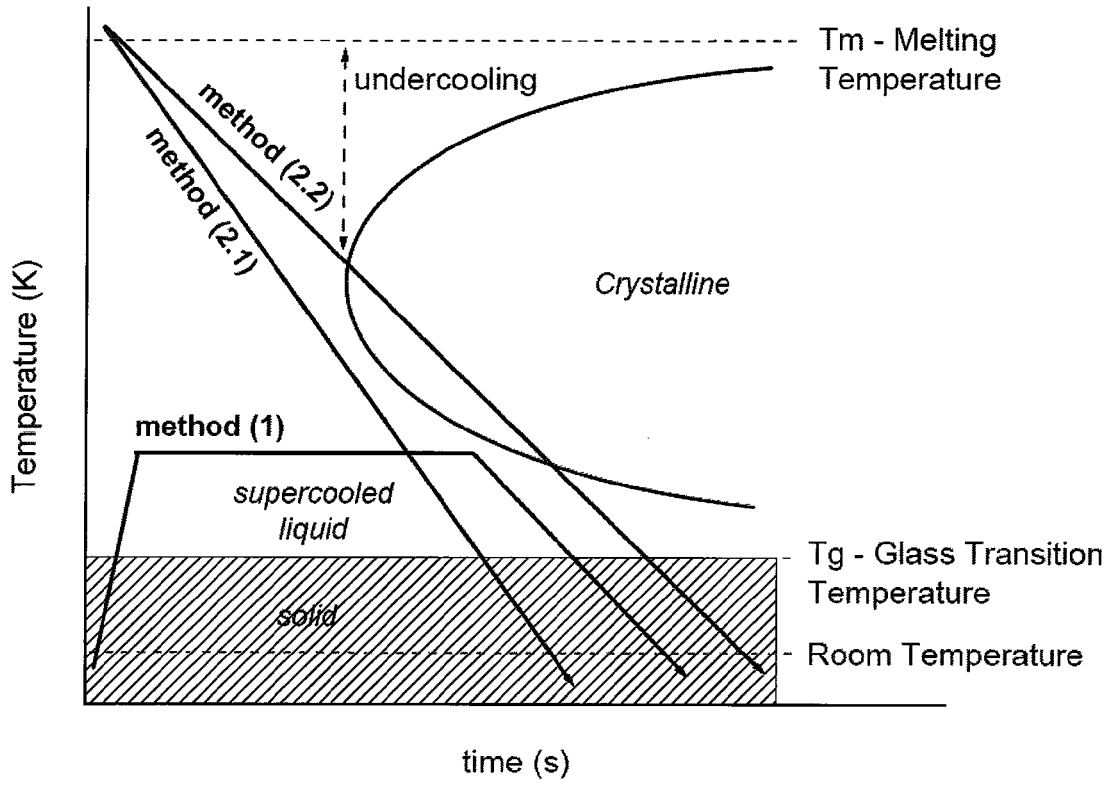
FIG. 4 provides a continuous cooling transformation (CCT) schematic providing temperature profiles for exemplary joining methodologies in accordance with the current invention.
Figure 5:
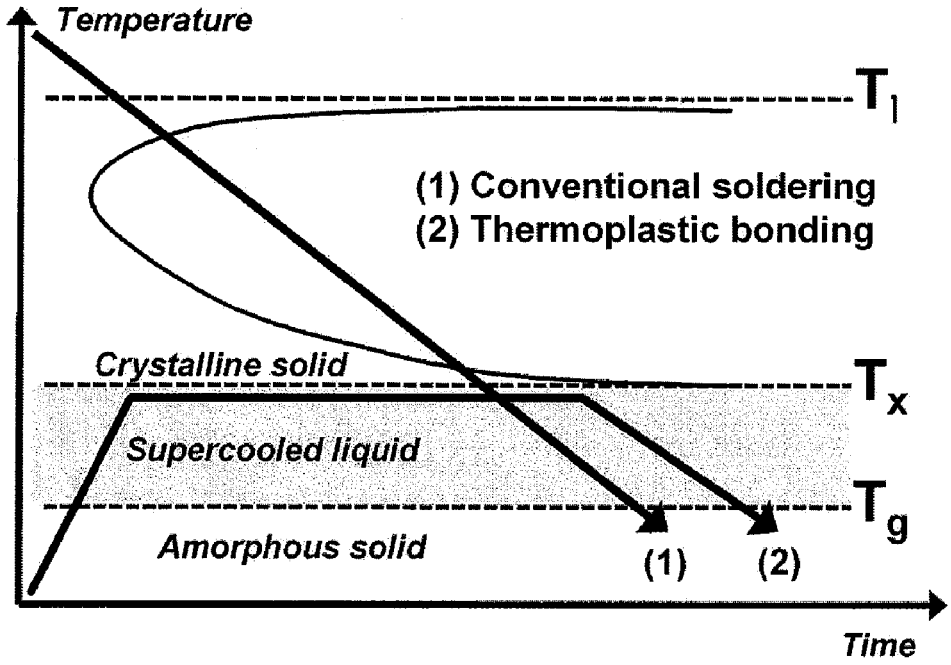
FIG. 5 provides a continuous cooling transformation (CCT) schematic providing a comparison of the temperature profile for a conventional soldering process and a thermoplastic joint formation process in accordance with the current invention.

As shown in FIG. 4, under this thermoplastic joining process the BMG is heated to a temperature between the BMG material's glass transition ($T_g$) and crystallization ($T_x$) temperatures. At this temperature the BMG becomes a supercooled liquid. Because of the unique rheological properties of these BMGs, wetting may take place in this supercooled liquid state as opposed to a molten state (above $T_m$) as would be required with a conventional solder material (see FIG. 5). Supercooled liquids, depending on their fragility, can have enough fluidity to spread under minor pressure. The fluidity of supercooled liquids of bulk metallic glasses is on par with thermoplastics during plastic injection molding. As a result, BMGs under these thermoplastic conditions can be used as a thermoplastic joining material.

During the operation of the thermoplastic joining process the BMG is positioned on the area of the solder joint, along with an optional flux. Typically fluxes are applied to reduce oxides and other impurities on the substrate surface. In the current invention any flux may be applied that is compatible with the BMG materials. The assembly is then heated to a temperature above glass transition temperature, into the supercooled Liquid region. The preferred processing temperature is usually much lower than the alloy's melting temperature and the crystallization kinetics are slow. As a result, the part can be held in the amorphous, supercooled liquid for a few minutes up to hours depending upon the particular amorphous alloy being used. Optionally this heating may be followed by mechanically pressing the parts to help the flow of the BMG joining materials over the parts to be joined, as necessary. The assembly is then cooled to room temperature following soldering.

In summary, in a thermoplastic joining process the joining temperature (~$T_g$) is "decoupled" from the melting temperature of the joining material ($T_m$). As a consequence, low temperature thermoplastic joining can be achieved without lowering the melting temperatures of the joining material, allowing for joints with superior reliability. Moreover, after bonding, a wide variety of nano/microstructures from fully amorphous, partially-crystallized to fully-crystallized structures can be obtained as a final state through controlled crystallization via post-bonding annealing for optimum electrical conductivity, creep and fatigue properties tailored to a given application. It has been surprisingly discovered that this technique posts significant advantage over conventional joining methods, such as soldering, because the glass transition temperatures of the BMG alloys are much lower than melting point. Indeed, the amorphous joining technique of the current invention typically requires a processing temperature range at a few hundred degrees (Celsius) below those required by conventional joining methods such as soldering, welding or brazing. As a result the deleterious effects of heat-effected zones, brittle oxide layers and unstable intermetallics typically found in conventional joining techniques will be reduced or eliminated in the joints formed in accordance with the current methodology.

As such, by judiciously choosing the amorphous alloy system, the amorphous joining technique of the current invention may be used for a wide variety of metal-to-metal joints using thermoplastic processing, not limited to the applications found in any specific industry. For example, the technique could be applied to metal-to-BMG joining, or BMG-to-BMG joining, fasteners, etc. Ideal processing conditions will obviously depend on different alloy family and composition, a fuller description of which is provided below. For an example, a processing temperature may be 30-60° C. above Tg for gold and platinum based BMG solder. Tg for one particular gold BMG is 130° C. (J. Schroers, B. Lohwongwatana, W. L. Johnson and A. Peker, Applied Physics Letters 87 061912 (2005), the disclosure of which is incorporated herein by reference), which means the thermoplastic soldering process could be conducted at 160-170° C., which is significantly below the 210-230° C. processing temperature window for a conventional Sn-based solder.

Description of Deeply Undercooled Joining Method

In a second exemplary joining method a deep undercoating process may be used. This processing technique utilizes the deeply undercoating characteristic of metallic glasses to form a liquid joining material that can be used to create joints that can be amorphous, crystalline or partially crystalline. Two potential processing paths labeled as "Method 2.1 and 2.2" on FIG. 4 are described below.

As shown in FIG. 4, there are two possible temperature profiles for this deeply undercooled method. In the first process, labeled as Method 2.1 in FIG. 4, a glassy joint may be formed using a deeply undercooled glass forming liquid. In such a technique, the joining BMG material is first melted above Tm, then quickly quenched to low temperature. The alloy's stability against crystallization allows the material to "vitrify" or freeze in the amorphous state when the melt is deeply undercooled to below Tg. Once the temperature of the joining material has been brought below Tg, it can then be further quenched to room temperature. The resulting joint will be fully amorphous if the cooling rate is sufficient to bypass crystallization as shown in the Method 2.1 curve of FIG. 4.

It is not a coincidence that good glass forming liquids deeply undercoat before crystallization takes place. Indeed, this is an important requirement for a material to be considered a BMG. In other words, the liquid metal needs to undercoat deeply enough so that the temperature is low, the atomic mobility is restricted, and the atoms become "frozen" before they form crystals. Such a deep undercoating process also improves the chance that the joining material will solidify as an amorphous metal. Path C in FIG. 6 demonstrates the way an alloy can ultimate be frozen into a non-crystalline amorphous state.

Figure 6:
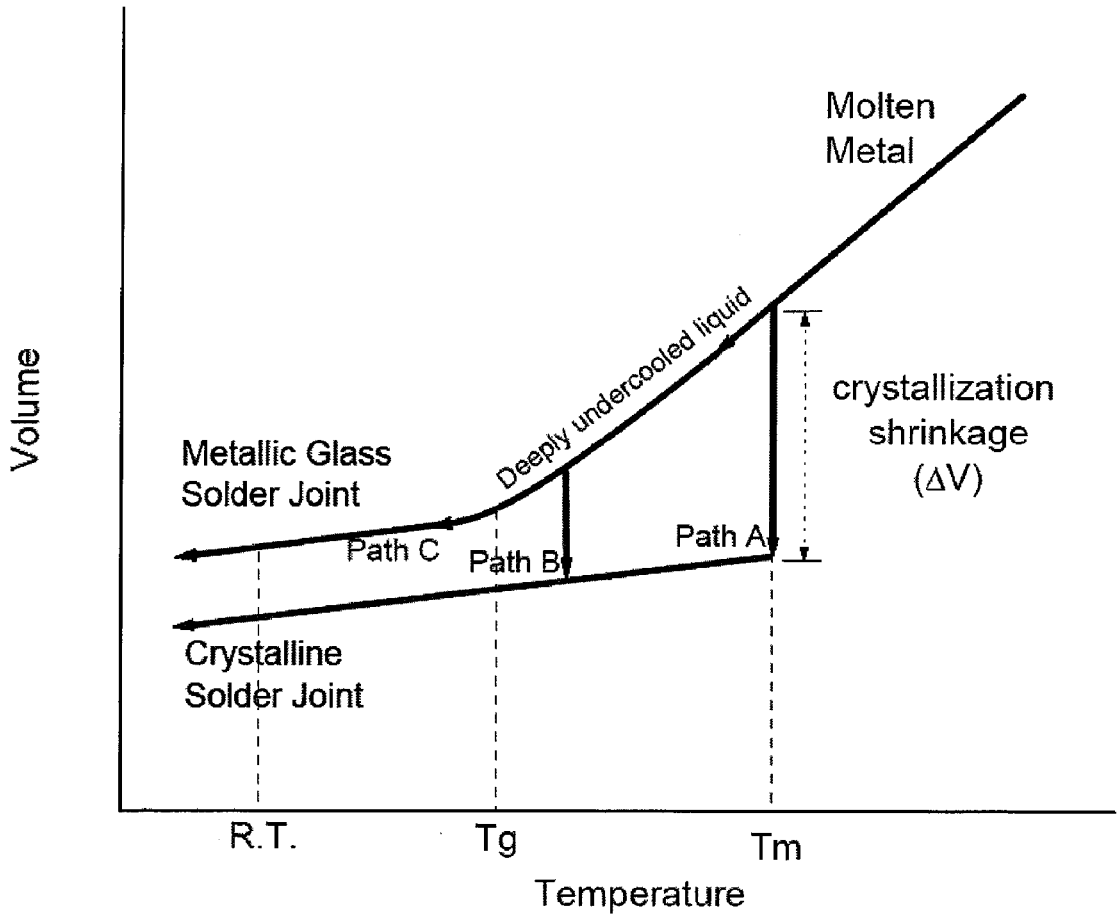
FIG. 6 provides a graph showing the relationship between volume and temperature during cooling from molten state.

In summary, FIG. 6 shows the relationship between volume and temperature during cooling from molten state. A conventional solder, cooling from the melt, follows Path A in FIG. 6. As shown, there is a sharp change in volume (ΔV~3-

8%) when the atoms solidify into a crystal lattice. This volume shrinkage contributes to residual thermal stress in the solder joint. In contrast, when an amorphous alloy is used no volume change associated with crystallization takes place, and less thermal stress is stored in the solder joint. As a result, by using the temperature profile labeled as Path B in FIG. 6, the alloy can undercoat and solidify with less solidification shrinkage. In the exemplary graph provided in FIG. 6, the solidification shrinkage is approximately 0.5%. Because of the extremely low shrinkage rate ultra-low-stress interconnects or joints can be achieved using this method.

In the second "undercooled" process, labeled as Method 2.2 in FIG. 4, a crystalline or semi-crystalline joint may also be formed. This method, as described briefly in the earlier section, takes advantage of the deep undercoating properties of the BMGs, but does not require the cooling rate to be fast enough to bypass the crystallization event—nor does it require the alloy to be an exceptional glass former. Crystallization still takes place, but the undercoating is large enough to minimize solidification shrinkage. A fuller understanding of the control over the Level of crystallinity available under this methodology can be found with reference to FIG. 6.

Again, FIG. 6 provides a volume and temperature diagram of a joint material cooling process. Path A shows the alloy with minimal undercooling. An alloy cooled with the temperature profile shown by Plot A would solidify in the crystalline state at the melting temperature, with substantial shrinkage. At the other extreme, as discussed above, an alloy cooled with the temperature profile shown by Path C is cooled at a rate sufficient to bypass the crystallization event completely. The semi-crystalline undercooled method (Method 2.2 in FIG. 4) follows a compromise temperature profile shown as Path B in FIG. 6. Following this temperature profile allows for the material to accommodate substantial undercooling, greatly reducing the solidification shrinkage. Accordingly, using the temperature profile labeled Method 2.2 in FIG. 4, the degree of crystallinity in the joint can be controlled by varying the cooling rate. As a result, this method can be used to generate a composite joint with dendritic structure branching out in an amorphous matrix. There have been numerous reports that crystalline-metallic glass composites have favorable mechanical properties, such as improved ductility, which would result in a more reliable joint and interconnects. (See, C. C. Hays, C. P. Kim and W. L. Johnson, Physical Review Letters 84, 2901-2904 (2000), the disclosure of which is incorporated herein by reference.)

Description of Molten Plastic Processing Method

Figure 7:
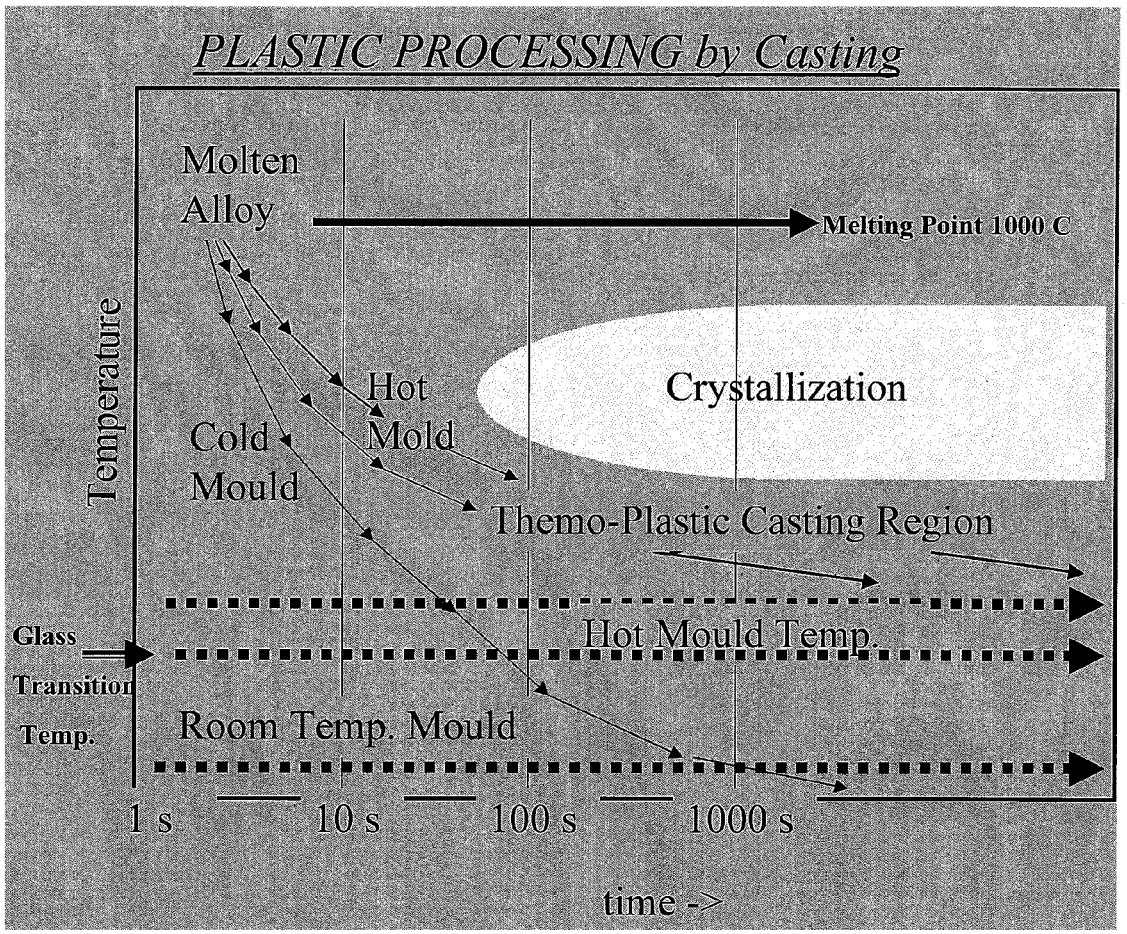
FIG. 7 provides a continuous cooling transformation (CCT) schematic providing temperature profiles for a molten plastic processing exemplary joining methodology in accordance with the current invention.

In another alternative joining method, plastic processing of the joint material from the molten state is utilized. The plastic processing method is explained schematically in FIG. 7. In this process the glass forming alloy is heated above the melting temperature, then injected into a mold that is being held at a predetermined lower temperature. The metal is cooled to the deep supercooled liquid region quickly enough to avoid crystallization, at which point it can undergo thermoplastic processing. In summary, this process is similar to casting, but the alloy is held below the crystallization "nose" for a longer time, where it can be processed like a plastic. In such a method the temperature at which the thermoplastic processing takes place can be controlled by the mold's temperature.

Description of Joint Surfaces

Although the above discussion has focused on the appropriate heating and cooling temperature profiles to be used with the joining method of the current invention to take advantage of the unique rheological properties of the amorphous materials, it should also be understood that the invention is also directed to engineering the joint surfaces to take advantage of the unique properties of the amorphous alloy materials. For example, another clear advantage of using these amorphous processing techniques is that the material can flow and fill up spaces (or volumes) of various shapes and geometries. As a result, a mechanical interlocking feature could be introduced on metal surfaces to increase the mechanical reliability of a joint. Having these surface features can dramatically improve the strength of the joint, because it allows the joint to utilize the mechanical property of both the BMG and the joint materials instead of relying solely on the wetting properties of the joining material.

Figure 8A:
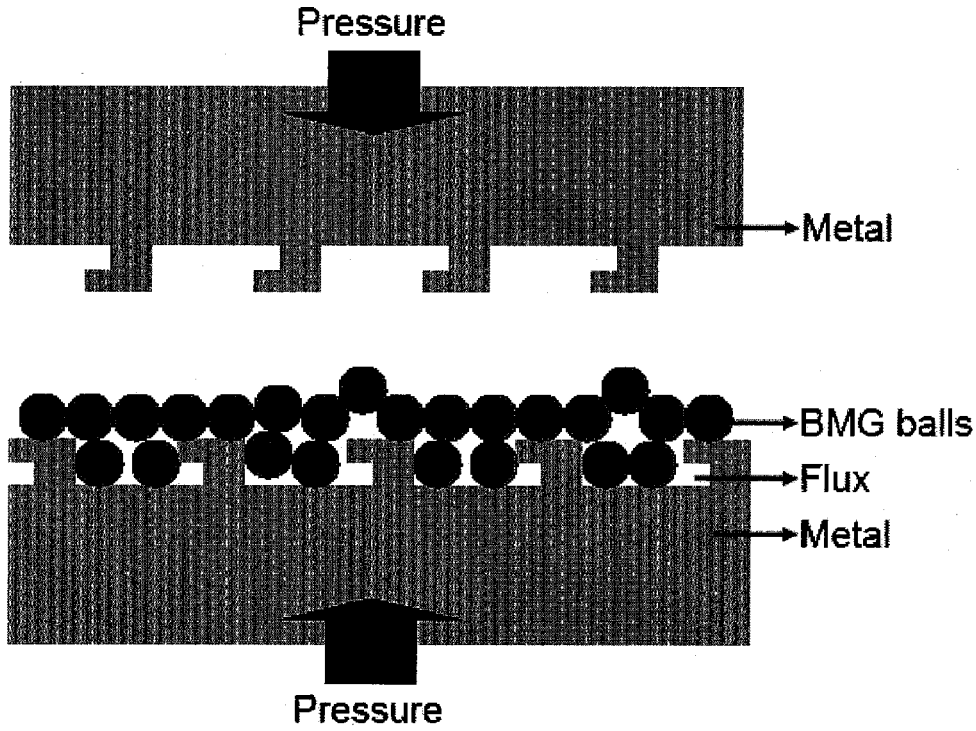
FIGS. 8*a* and 8*b* provide schematics of an exemplary metal-to-metal joining process.
Figure 8B:
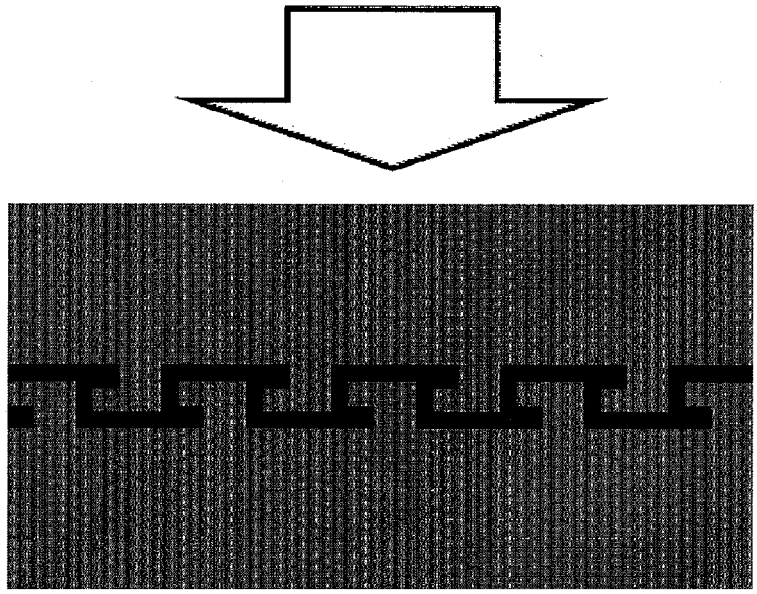

For example, the process of forming an exemplary joint is shown in FIG. 8. As shown, the BMG joining material can be provided in any suitable form. In the example the BMG is provided in the form of balls that can be applied where needed to form the joint. Flux can then be optionally applied to create a good wetting surface. The joining area is heated to a temperature sufficient to activate the flux, and is then heated to another temperature in accordance with the joining technique chosen. In the example shown in FIG. 8 above, a thermoplastic technique has been chosen, so the temperature is raised to the Tg of the BMG used, and then the two metal pieces are sandwiched together. When the BMG is sufficiently soft the balls of BMG will thermoplastically flow and fill up the space between the two metal surfaces. The joint is then cooled down to room temperature. Because the rheological properties of the BMG joining material allows the joining material to flow across any surface feature mechanical interlocks can be formed into the surface, as shown in FIG. 8*a*.

Figure 9A:
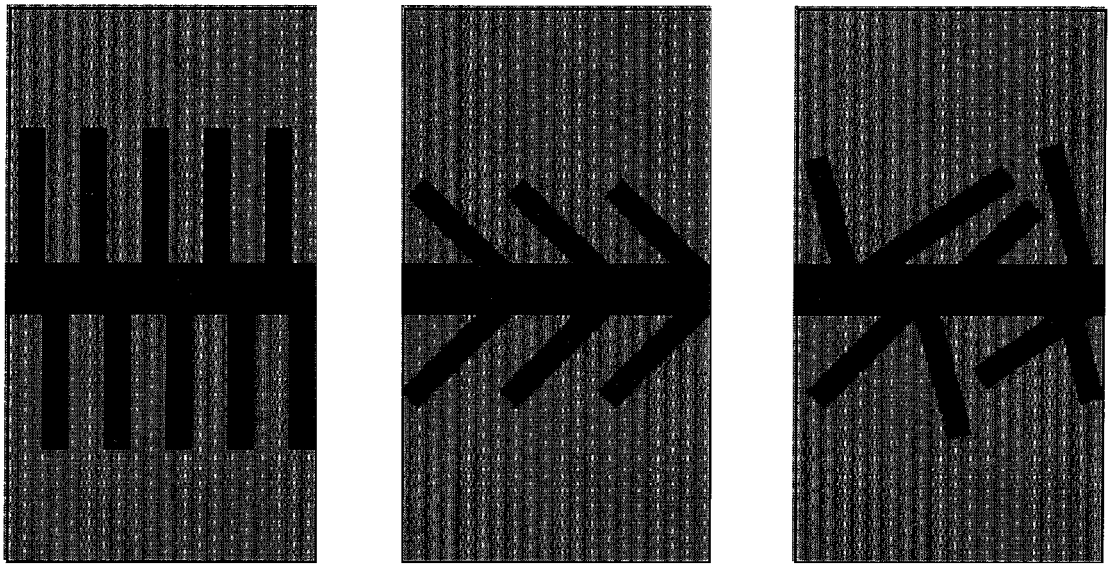
FIG. 9*a* provides schematics of different channel designs for metal joining using BMGs.
Figure 9B:
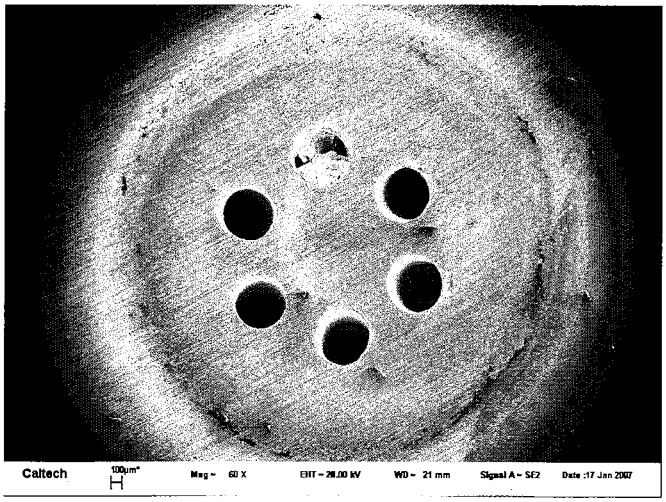
FIG. 9*b* provides a micrograph of a joint interface surface having mechanical interlock channels formed therein in accordance with the current invention.

Although interlocking features are shown in FIG. 8, the interlocking feature could be in the form of a simple void, such as, for example, a slot, tunnel or hole preferably formed at slanted angles to decouple the stress components into different planes as shown in FIG. 9*a*. In this figure, the orange area represents BMG material that can flow at a temperature slightly above Tg. The tunnels are perpendicular to the metal surface in the left image. To decouple the stress components into different directions, the tunnels could be slanted as shown in the middle image. Last but not least, the slant angles could be completely random in 3D axis. FIG. 9*b* provides an SEM micrograph showing a test surface in which such features have been formed. Specifically, in the example shown in FIG. 9*b* holes were drilled on a copper surface at angles. Tests on the surface in comparison with a conventional featureless surface showed that the debonding strength of the holed surface was substantially improved.

Although on relatively simply features are shown and described above, it should be understood that more complicated features could be introduced to the materials to be joined, such as, for example, hollowed chambers inside the material to be joined so that metallic glass could flow inside and fill up the chamber. Such a mechanical interlock could be a desirable alternative to current conventional fasteners such as rivets and fasteners.

Description of Alloys

Although the above description has focused on specific joining methodologies in accordance with the current invention and not on the amorphous joining materials themselves, it should be understood that the inventive methodologies may be used with any amorphous alloy material. The only limitation for the suitability of any particular amorphous material is that it must have a temperature profile, i.e., melting, glass transition, and crystallization temperatures suitable for use in joining the materials of interest. The rheological properties of some exemplary amorphous alloys are provided in Table 1, below.

TABLE 1

Rheological Properties of Exemplary Amorphous Alloys

| Alloy | M | Tg [° C.] | Tx [° C.] | DT [° C.] | Tl [° C.] | S | D* | App. | d |
|---|---|---|---|---|---|---|---|---|---|
| $Zr_{41.2}Ti_{13.8}Cu_{12.5}Ni_{10}Be_{22.5}$ | 47.9 | 349 | 426 | 77 | 714 | 0.211 | 23.8[c] | Oxidized | 14.1 |
| $Zr_{44}Ti_{11}Cu_{10}Ni_{10}Be_{25}$ | 47.2 | 350 | 471 | 121 | 720 | 0.327 | 18.9[a] | Oxidized | 20.5 |
| $Zr_{57}Nb_5Cu_{15.4}Ni_{12.6}Al_{10}$ | 45.9 | 405 | 470 | 65 | 847 | 0.147 | 19.7[c] | Severely Oxidized | 11.2 |
| $Zr_{58.5}Nb_{2.8}Cu_{15.6}Ni_{12.8}Al_{10.3}$ | 45.9 | 400 | 480 | 80 | 845 | 0.18 | 19.7 | Severely Oxidized | 14.65 |
| $Pd_{43}Ni_{10}Cu_{27}P_{20}$ | 65.2 | 305 | 406 | 101 | 554 | 0.406 | 12 | Oxidized | 25.55 |
| $Au_{49}Ag_{5.5}Pd_{2.3}Cu_{26.9}Si_{16.3}$ | 52.8 | 130 | 184 | 54 | 382 | 0.214 | 16 | Metallic shiny | 21.56 |
| $Pt_{57.5}Cu_{14.7}Ni_{5.3}P_{22.5}$ | 51.9 | 236 | 325 | 89 | 540 | 0.293 | 16.4[b] | Metallic shiny | 32.7 |
| $Fe_{48}Cr_{15}Mo_{14}Er_2C_{15}B_6$ | | | | | | 0.079 | | Severely Oxidized | 6.2 |
| $Mg_{65}Cu_{25}Y_{10}$ | 42.7 | 155 | 219 | 64 | 484 | 0.195 | 22.1 | Metallic | 17.9 |
| Zr65Al10Ni10Cu15 | 59.4 | 368 | 473 | 105 | 888 | 0.202 | 16.6 | Severely Oxidized | 13.6 |

As shown in Table 1, the Tg and Tx temperatures of amorphous alloys can range from as low as 130° C. to well over 400° C. As a result, amorphous alloy materials can be used in low temperature joining processes such as soldering where joining temperatures are typically below 200° C. to welding and braizing where joining temperatures typically exceed 300 or 400° C. Although only a few exemplary amorphous alloys are set forth above, it should be understood that any suitable amorphous alloy may be used. A more detailed description of some of the well-known amorphous alloy families is provided below, although it should be understood that this listing of alloys is only meant to describe some exemplary alloys, and any alloy having rheological properties suitable for use in the joining methods of the current invention may be used.

The following discussion will follow a few rules that that will be used to classify families (or systems) of bulk metallic glasses (BMGs):

Unless otherwise noted alloy compositions are expressed in atomic percentages.

X-based BMG refers to the families of alloy composition that has X as the main element (majority element). For example, $Pd_{77.5}Cu_6Si_{16.5}$ and $Pd_{40}Cu_{30}Ni_{10}P_{20}$ would both be considered Pd-based BMGs.

It should be understood that this survey focuses on those amorphous alloy systems that have strong potential as engineering material, brazing/soldering/bonding material, and/or electronic conductor, it is by no means to be construed as a complete list of those amorphous alloys that can be used with the joining methods of the current invention.

The discussion will reference the truncated periodic table provided in FIG. 10. This periodic table excludes most elements that are gaseous or liquid at (or near) room temperature, elements that need to be synthesized, elements that are radioactive and elements that are non-metal. However, located at the top right corner of the truncated table, these metalloids (ML) are sometime used as alloying elements. Moreover, it should be understood that the claimed BMG compositions could include other elements not represented in above table.

When a group of metals are cited, one or more metals shall be used in the composition.

Turning to the truncated periodic table provided in FIG. 10, the metals in group IA are Alkali Metals (AM) which includes, e.g. Li, Na, K. Group IIA is known as Alkali Earth Metals (AEM) which includes, Be, Mg, Ca. Transition metals (TM) could be categorized into at least two sub-groups: Early Transition Metal group (ETM) which represents metals from group IB-IVB and Late Transition Metal group (LTM) which represents group VIIIB. Within the transition metals group, the Noble Metal sub-group (NM) refers to, strictly speaking, the metals that have filled d-bands (Cu, Ag and Au). However, this NM sub-group is occasionally known to include precious metals and/or platinum group metal (PGM) in jewelry industry, e.g. Pt, Pd, Rh, Ru, etc. Using these loose definitions, some metals in group VIIIB, e.g. Fe, Co, Ni, will be referred to as LTM, and some metals in group VIIIB that are more "noble" or more "inert" will be referred to as NM. The TM group will therefore include metals categorized as ETM, LTM, NM and metals included in group VB-VIIB that do not belong in other subgroups (ETM, LTM and NM), e.g. Nb, Mo, Cr, etc. The Lanthanide series metals, LM, are shown at the bottom of the truncated periodic table. The LM-based BMGs were among the first bulk glasses discovered by Inoue and coworkers and these include La itself, and other Lanthanide series metals, e.g. Ce, Nd, Sm, Gd, etc. (A. Inoue, T. Zhang and T. Masumoto, Mater. Trans. Japan. Inst. Metals 30, 965 (1989), the disclosure of which is incorporated herein by reference.) Last but not least, the simple metal group (M) represents group AM, AEM and IIIA-VIA metals that are not metalloids, e.g. Al, Ga, Sn, Sb, Ge, etc. RE represents rare earth metal group, which includes both LM series metals and Actinide series metals, e.g. Th, Pa, U. Because most of the Actinoids have to be synthetically prepared and some could be expensive, Actinide series metals are not commonly used as alloying elements in BMGs. However, for simplicity these Actinide metals shall be treated as belonging in the LM group. These abbreviations are summarized in Table 2, below.

TABLE 2

| Abbreviation Meanings | |
|---|---|
| Abbreviation | Translation |
| AM | Alkali Metals |
| AEM | Alkali Earth Metals |
| TM | Transition Metals |
| ETM | Early Transition Metals |
| LTM | Late Transition Metals |
| NM | Noble Metals |
| ML | Metalloids |
| LM | Lanthanide Metals |
| M | Simple Metals |

In the following discussion the alloy compositions will be explained using simple form $A_{100-x-y}B_xC_y$. Each composition may consist of one or more elements chosen from respective group. The value of x and y represent atomic percent of each group. For example, $Zr_{65}Al_{10}Ni_{10}Cu_{15}$ could be regrouped as $(Zr_{100-10-25})(Al_{10})(Ni_{10}Cu_{15})$, which can be represented by the form $ETM_{100-10-25}M_{10}LTM_{25}$.

Noble Metal Alloys

Typical noble metal alloy compositions take the form of the following:

$NM_{100-x-y}LTM_x M_y$ $NM_{100-x-y}ETM_x M_y$ $NM_{100-x-y}(ELM,LTM)_x M_y$ $NM_{100-x-y}(ELM,LTM)_x ML_y$ $NM_{100-x-y}(ELM,LTM)_x (M,ML)_y$ $NM_{100-x-y}(ELM,LTM,LA)_x (M,ML)_y$

A survey of the literature indicates that for these NM amorphous alloys, summarized in Table 3 below, typically the value of x varies from 0-45% and value of y varies from 0-42%.

TABLE 3

| Exemplary NM Amorphous Alloys | |
|---|---|
| Alloy | Citation |
| Au—Si at near eutectic composition when y = 17-25% | Klement, w., Jr., et al., Nature, 187: 869 (1960). |
| Pd—Si and Pd—Cu—Si | Chen, H. S., and Turnbull, D., J. Chem. Phys. 48: 2560-71 (1968). |
| Pd—Ni—P when x = 40 and y = 20 | J Drehman, A L Greer, and D. Turnbull, Appl. Phys. Lett. 41, 716 (1982). |
| Pd—Cu—Ni—P when x = 40 and y = 20 (3:1 Cu:Ni ratio) | Inoue, A. and Zhang, T., Mater. Trans. JIM 37 185-8 (1996). |
| Pd—Ni—Fe—P when x = 40 and y = 20 (1:1 Ni:Fe ratio) | Chen, H. S., and Turnbull, D., Acta Metall. 22, 1505 (1974). |
| Pd—Cu—Si when x = 6 and y = 18 | |
| Pd—Cu—Si when x = 4% and y = 16.5% | |
| Pd—Cu—B—Si | |
| Pt—Ni—P when x = 15 and x = 25 | |
| Pt—Ni—Cu—P when x = 19.7 and y = 22.8 (Cu14.7 Ni5) | J. Schroers and W. L. Johnson, Appl. Phys. Lett. 84, 3666 (2004). |
| Pt—Co—Ni—Cu—P when x = 20-45% and y = 5-30% | |
| Pt—Cu—Co—P when x = 18% and y = 5-32% | |
| Au—Cu—Si | B. F. Dyson, T. R. Anthony, and D. Turnbull, Journal of Applied Physics, 38, 3408 (1967). |
| Au—Sn—Pb when x = 22.5 and y = 22.5 | M. C. Lee, et al., Appl. Phys. Lett., 4, 383 (1982). |
| Au—Ag—Cu—Si when x = 29% and y = 20% | J. Schroers, J. of Metals 5, 34 (2005). |
| Au—Pd—Cu—Si when x = 29.2% and y = 16.5% | |
| $Au_{49}Ag_{5.5}Pd_{2.3}Cu_{26.9}Si_{16.3}$ when x = 26.9% & y = 16.3% | |

The disclosures of each of the above references are incorporated herein by reference.

Lanthanide Metal Alloys

Typical lanthanide metal alloy compositions take the form of the following:

$LM_{100-x-y}TM_x(M,ML)_y$ $LM_{100-x-y}(ETM,LTM)_x(M,ML)_y$ $LM_{100-x-y}TM_x(M,ML)_y$ $LM_{100-x}TM_x$ $LM_{100-y}(M,ML)_y$

A survey of the literature indicates that for these NM amorphous alloys, summarized in Table 4 below, typically the value of x ranges from 0-49% and y ranges from 0-49%.

TABLE 4

| Exemplary LM Amorphous Alloys | |
|---|---|
| Alloy | Citation |
| La—Al—Ni when x = 0-50% and y = 0-50% | A. Inoue et al., Mater Trans., JIM, 31: 104 (1989) & A. Inoue, N. Masumoto and T. Masumoto, Mater. Trans. JIM, 31: 493 (1990). |
| La—Al—Cu and La—Al—Co when x = 0-55% and y = 0-50% | A. Inoue, N. Masumoto and T. Masumoto, Mater. Trans. JIM, 31: 493 (1990) & A. Inoue, et al., Mater. Trans., JIM, 34, 351 (1993). |
| La—Co—Ni—Cu—Al when x = 20% and y = 25% ($Co_5Ni_5Cu_{10}$) | A. Inoue, et al., Mater. Trans., JIM, 34, 351 (1993). |
| La—Ga-TM | A. Inoue et al., Mater Trans., JIM, 31: 104 (1989). |
| Nd—Al—Ni—Cu—Fe when x = 15% and y = 10 + 10 + 5% | Zhang, Z., et al., Mat. Sci. & Eng. A, 385, 38 (2004). |
| Nd—Al—Ni—Co—Cu when x = 11% and y = 8 + 5 + 15% | Zhang, Z., et al., Mat. Sci. & Eng. A, 385, 38 (2004). |
| Nd—Al—Fe—Co when x = 10% and y = 2 + 10% | Zhang, Z., et al., Mat. Sci. & Eng. A, 385, 38 (2004). |
| Ce—Al—Ni—Cu—Nb when x = 10% and y = 12.5 + 15.5 + 5% | B. Zhang, et al., Appl. Phys. Lett. 85, 61 (2004). |

The disclosures of each of the above references are incorporated herein by reference.

Aluminum Metal Alloys

Typical aluminum metal alloy compositions take the two basic forms, first those based on LM and those based on other materials. In the first instance these Al-based systems emerge from LM-based systems by simply introducing more Al into the composition so that the Al content exceeds LM content. Hence, the systems become Al rich and take the following forms:

$Al_{100-x-y}LM_xTM_y$ $Al_{100-x-y}LM_xM_y$ $Al_{100-x-y}LM_x(TM,M)_y$ $Al_{100-x-y}LM_xML_y$ $Al_{100-x-y}LM_x(TM,ML)_y$ $Al_{100-x-y}LM_x(TM,M,ML)_y$

A survey of the literature indicates that for these Al-LM amorphous alloys typically the value for x ranges from 0-32% and y from 0-35%. Some exemplary Al/LM amorphous alloy compositions include the following:

Al-La-Ni when x=20% and y=30% or when x=5% and y=10%;

Al-Ce-Ni when x=2-25% and y=0-25%;

Al-Ce-Cu,Ni when x=3-25% and y=0-29%; and

Al-Ce,Y-Cu,Ni when x=4-25% and y=0-27%.

Other types of Al amorphous alloy take the forms:

$Al_{100-x-y}ETM_xLM_y$ $Al_{100-x-y}ETM_xM_y$ $Al_{100-x-y}TM_x(TM,M,ML)_y$ $A_{100-x-y}LTM_xML_y$ $Al_{100-x-y}LTM_x(M,ML)_y$ $Al_{100-x-y}LTM_x(TM,M,ML)_y$

A survey of the literature, summarized in Table 5 below, indicates that for these other Al amorphous alloys typically the value for x ranges from 0-36% and y from 0-35%.

TABLE 5

| Exemplary Al Amorphous Alloys | |
|---|---|
| Alloy | Citation |
| Al—Y—Ni when x = 1-27% and y = 0-22% | Inoue A., J. Non-Cryst. Solids, 156-158, 192-195 (1998). |
| Al—Ti—(Ni,Cu,Nb) when x = 0-31% and y = 0-33%<br>Al—Y—(Ni,Cu) when x = 0-29% and y = 0-32%<br>Al—(Zr,Ti)—(Ni,Cu) and Al—(Zr,Ti)—(Ni,Cu)—Si when x = 5-40% and y = 0-32%<br>Al—Fe—B and Al—Fe—B—Ce, Y when x = 4-25% and y = 3-24% | Lohwongwatana, Dissertation, California Institute of Technology (2007). |
| Al—Cu—Mg when x = 1-35% and y = 1-29% | S. J. Enouf, S. J. Poon and G J. Shiflet, Phil. Mag. Lett. 81 (2001). |

The disclosures of each of the above references are incorporated herein by reference.

Description of Simple Metal Alloys

The simple metal group includes AM (e.g. Li, Na), AEM (e.g. Mg, Ca) and simple metals in groups IIIV-VIA (e.g. Al, Bi). The most studied compositions are Al-based and Mg-based. Because Al-based systems are discussed above, this section will focus on M metals other than Al. Although there is a wide variety of such materials, in general alloy compositions of this group take the following forms:

$M_{100-x-y}TM_xM_y$ $M_{100-x-y}TM_xLM_y$ $M_{100-x-y}(ELM,LTM,NM)_xM_y$ $M_{100-x-y}(ELM,LTM,NM)_xML_y$ $M_{100-x-y}(ELM,LTM)_x(M,ML)$ $M_{100-x-y}(ELM,LTM,LM)_x(M,ML)_y$

A survey of the literature, summarized in Table 6 below, indicates that for these other Al amorphous alloys typically the value for x ranges from 0-36% and y from 0-35%.

TABLE 6

| Exemplary M Amorphous Alloys | |
|---|---|
| Alloy | Citation |
| Mg-LM-(Ni,Cu,Zn) when x = 1-32% and y = 2-30%<br>Mg—Gd—Cu when x = 1-20% and y = 1-32%<br>Mg—Ca—Al when x = 0-25% and y = 0-35%<br>Mg—Ca-LM and Mg—Ca,Al-LN when x = 0-25% and y = 0-35% | A. Inoue, et al., Acta Mater. 49 (1998). |
| Mg—(Ni,Cu,Zn)—Y,Mg—(Ni,Cu,Zn)—Si,Mg—(Ni,Cu,Zn)—Ge and Mg—(Ni,Cu,Zn)—(La,Ce,Nd) when x = 0-35% and y = 0-35% | A. Inoue, T. Zhang and T. Masumoto, J Non Cryst Solids 156-158 (1993). |
| Mg—Cu—(Y,Gd) when x = 1-28% and y = 1-28% | Inoue, A, Materials Transactions Jim 33: 937 (1992). |
| Ca—Mg—Zn when x = 1-25% and y = 1-31% | Kim, D. H., J. Mater. Res. 19, 685 (2004). |
| Ca—Mg—(Cu,Ni,Ag) when x = 1-23% and y = 1-33% | A. Inoue and W. Zhang, Mater. Trans. JIM. 43, 2921 (2002). |

The disclosures of each of the above references are incorporated herein by reference.

Description of Late Transition Metal Alloys

Typically, late transition metal alloy compositions take the following forms:

$LTM_{100-x-y}\,TM_x\,M_y$ $LTM_{100-x-y}\,TM_x\,LM_y$ $LTM_{100-x-y}TM_x\,ML_y$ $LTM_{100-x-y}\,M_x\,LM_y$ $LTM_{100-x-y}\,M_x\,ML_y$ $LTM_{100-x-y}\,(M,LM)_x\,(M,ML)_y$ $LTM_{100-x-y}\,(TM,LM)_x\,(M,ML)_y$

A survey of the literature, summarized in Table 7 below, indicates that for these other Al amorphous alloys typically the value for x ranges from 0-37% and y from 0-38%.

TABLE 7

| Exemplary LTM Amorphous Alloys | |
|---|---|
| Alloy | Citation |
| Fe—(Al,Ga)—(P,C,B,Si,Ge) and Fe—(Ni,Mo)—(Al,Ga,P,B,Si) when x = 1-32% and y = 1-29% | A. Inoue, T. Shibata and T. Zhang. Mater. Trans. JIM 36 (1995). |
| (Fe,Co,Ni)—(Zr,Hf,Nb,Cr,Mo)—(P,B,Si,Al,Ga) when x = 1-32% and y = 1-29% | A. Inoue, N. Nishiyama and T. Matsuda. Mater. Trans. JIM 37 (1996) & A. Inoue, et al., Magnetics, IEEE Transactions, 35: 5, 3355-3357 (1999). |
| (Fe,Co,Ni)-LM-(P,B,Si,Al,Ga) when x = 1-32% and y = 1-29% | A. Inoue, T. Zhang and H. Koshiba. J Appl Phys 83 (1998). |
| Co—Ta—B when x = 1-30% and y = 1-26% | A. Inoue, et al., Magnetics, IEEE Transactions, 35: 5, 3355-3357 (1999). |
| Ni—Nb—(Sn,Ti,Ta) when x = 1-35% and y = 1-34% | A. Inoue and A. Takeuchi, Mater. Trans. 40, 1892 (2002); Johnson, W. L, et al. Applied Physics Letters 82, 1030 (2003); and Kim D. H., J. Non-Cryst. Solids 315 (2003). |

The disclosures of each of the above references are incorporated herein by reference.

Another set of LTM bulk-solidifying amorphous alloys are ferrous metal based compositions (Fe, Ni, Co). Examples of such compositions are disclosed in U.S. Pat. No. 6,325,868, and publications to (A. Inoue et. al., Appl. Phys. Lett., Volume 71, p 464 (1997)), (Shen et. al., Mater. Trans., JIM, Volume 42, p 2136 (2001)), and Japanese patent application No. 2000126277 (Publ. No. 0.2001.303218 A). One exemplary composition of such alloys is $Fe_{72}Al_5Ga_2P_{11}C_6B_4$. Another exemplary composition of such alloys is $Fe_{72}Al_7Zr_{10}Mo_5W_2B_{15}$.

Description of Early Transition Metal Alloys

This section includes all ETM-based systems other than Zr-based. For example, there have been recent developments on Cu-based, Ti-based, Mo-based, Nb-based, etc. Typically, alloy compositions of the ETM group take the following forms:

$ETM_{100-x-y}\,TM_x\,M_y$ $ETM_{100-x-y}\,TM_x\,LM_y$ $ETM_{100-x-y}\,TM_x\,ML_y$ $ETM_{100-x-y}\,M_x\,LM_y$ $ETM_{100-x-y}\,M_x\,ML_y$ $ETM_{100-x-y}\,(M,LM)_x\,(M,ML)_y$ $ETM_{100-x-y}\,(TM,LM)_x\,(M,ML)_y$

A survey of the literature, summarized in Table 8 below, indicates that for these other Al amorphous alloys typically the value for x ranges from 0-42% and y from 0-38%.

TABLE 8

| Exemplary LTM Amorphous Alloys | |
|---|---|
| Alloy | Citation |
| Cu—(Zr,Hf)—(Al,Y) when x = 1-45% and y = 0-30% | Xu, et al, Phys. Rev. Lett. 92 (2004). |
| Ti—Zr-(TM) when x = 1-36% and y = 0-30% | Inoue A., et al., Appl. Phys. Lett. 62, 137 (1993). |

TABLE 8-continued

| Exemplary LTM Amorphous Alloys | |
|---|---|
| Alloy | Citation |
| (Ti,Zr)—(Ni,Cu)—Be when x = 1-29% and y = 0-29% | (Kim and Johnson, U.S. Pat. No. 6,709,536) |
| (Ti,Zr)—(Ni,Cu)—Al when x = 1-32% and y = 0-22% | A. Inoue, Acta Mater. 48, 277 (2000). |
| Ti—Cu—Ni—Sn when x = 3-43% and y = 0-15% | Lin X H and Johnson W L, J. Appl. Phys. 78, 6514 (1995). and Zhang T & Inoue A. Mater Trans, JIM, 39 (1998). |
| (Mo,Ru,W)—(B, Metalloids) when x = 3-42% and y = 0-22% | Johnson, W. L., et al., Phys. Rev. B20, 1640 (1979). |
| W—Ru—B when x = 3-42% and y = 0-22% | H. Ohmura, et al., Phys. Rev. Lett., 92, 113002 (2004). |

The disclosures of each of the above references are incorporated herein by reference.

Description of Zr-Based Metal Alloys

This section includes all Zr-based systems, which is, arguably, the largest family of bulk glass formers known to date. There have been numerous patents and alloy composition discoveries. Instead of listing out all of the possible compositions, a listing of relevant patents, the disclosures of each of which are incorporated herein by reference is included below. The most relevant patents are U.S. Pat. Nos. 5,288,344; 5,368,659; 5,618,359; and 5,735,975 each of which disclose Zr-based bulk solidifying amorphous alloys.

One exemplary family of bulk solidifying amorphous alloys can be described by the formula $(Zr,Ti)_a(Ni,Cu,Fe)_b(Be,Al,Si,B)_c$, where a is in the range of from 30 to 75, b is in the range of from 5 to 60, and c in the range of from 0 to 50 in atomic percentages. A preferable alloy family is $(Zr,Ti)_a(Ni,Cu)_b(Be)_c$, where a is in the range of from 40 to 75, b is in the range of from 5 to 50, and c in the range of from 5 to 50 in atomic percentages. A still, a more preferable composition is $(Zr,Ti)_a(Ni,Cu)_b(Be)_c$, where a is in the range of from 45 to 65, b is in the range of from 7.5 to 35, and c in the range of from 10 to 37.5 in atomic percentages. Another preferable alloy family is $(Zr)_a(Nb,Ti)_b(Ni,Cu)_c(Al)_d$, where a is in the range of from 45 to 65, b is in the range of from 0 to 10, c is in the range of from 20 to 40 and d in the range of from 7.5 to 15 in atomic percentages. Furthermore, those alloys can accommodate substantial amounts of other transition metals up to 20% atomic, and more preferably metals such as Nb, Cr, V, Co.

EXAMPLES

An exemplary embodiment of the thermoplastic joining method of the current invention is demonstrated. In this approach, the bulk metallic glass is heated to the supercooled liquid region of the amorphous material and a small force is applied to the joint, resulting in good wetting and a strong bond. Complete wetting between a copper substrate and a platinum based bulk metallic glass is demonstrated and leads to atomistically intimate void-free interface, which is devoid of any reaction phase (e.g., intermetallic compounds). A joint produced by this method exhibits tensile strength up to 50 MPa, which meets or exceeds that of conventional Sn-based solders.

Figure 11:
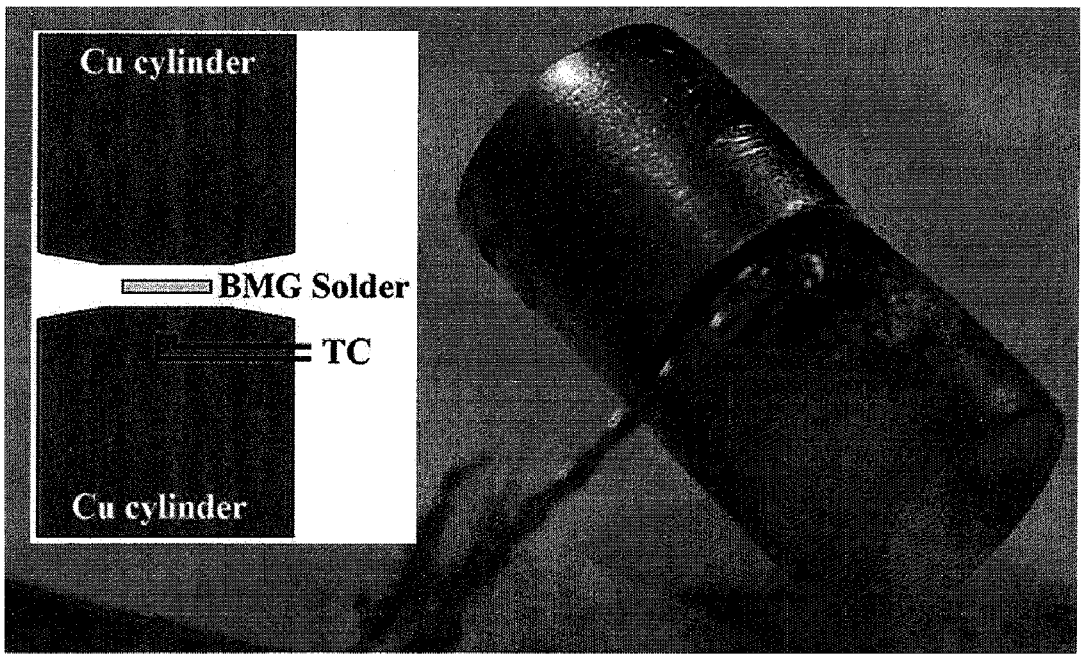
FIG. 11 provides a schematic diagram of an experimental configuration of the test copper-copper joint set forth herein.

In order to demonstrate this novel joining process, a platinum based BMG was selected because of its oxygen inertness and low $T_g$ comparable to the solder reflow temperatures in microelectronics applications. A fully amorphous strip of $Pt_{57.5}Cu_{14.7}Ni_{5.3}P_{22.5}$ with thickness of about 0.5-mm was prepared to have $T_m$, $T_g$, $T_x$ of 499, 226.1, 299.2° C., respectively (measured by a Netzsch 404C DSC at a scan rate of 20° C.-min$^{-1}$.). Copper cylinders with 6.35-mm diameter and 6.35-mm length of 99.996% purity (produced by Alfa Aesar) were used as substrates. Machining reduced the diameter at the bonding surface to 3-mm, as shown in the inset in FIG. 11. The cylinders were dipped into nitric acid to remove any oxide on the copper surface. The glassy solder was stacked between two copper cylinders without flux, and the assembly was placed in a loading fixture inside a vacuum chamber equipped with RF heating system. Temperature was monitored via a K-type thermocouple spot welded to one of the copper cylinders. The joining process was performed in a high vacuum of order of $10^{-6}$ mbar to minimize the possibility of oxidation. The assembly stack was heated to the process temperature at a heating rate of approximately 100° C.-min$^{-1}$, held at the process temperature for 2 minutes, then cooled. FIG. 11 shows the joint formed by the BMG thermoplastic joining process. After joining, the electrical resistance of each joint was measured by a 4-point probe method with approximately 5-mm inner probe spacing and the bond strength was measured mechanically using Instron 5500R frame with a constant crosshead speed of 0.2-mm-min$^{-1}$. Fracture surfaces were examined by a Leo 1550 VP Field Emission SEM. The joint cross section was cut out by ultramicrotomy and examined using an FEI Tecnai F30UT high resolution TEM operated at 300 kV.

Figure 12:
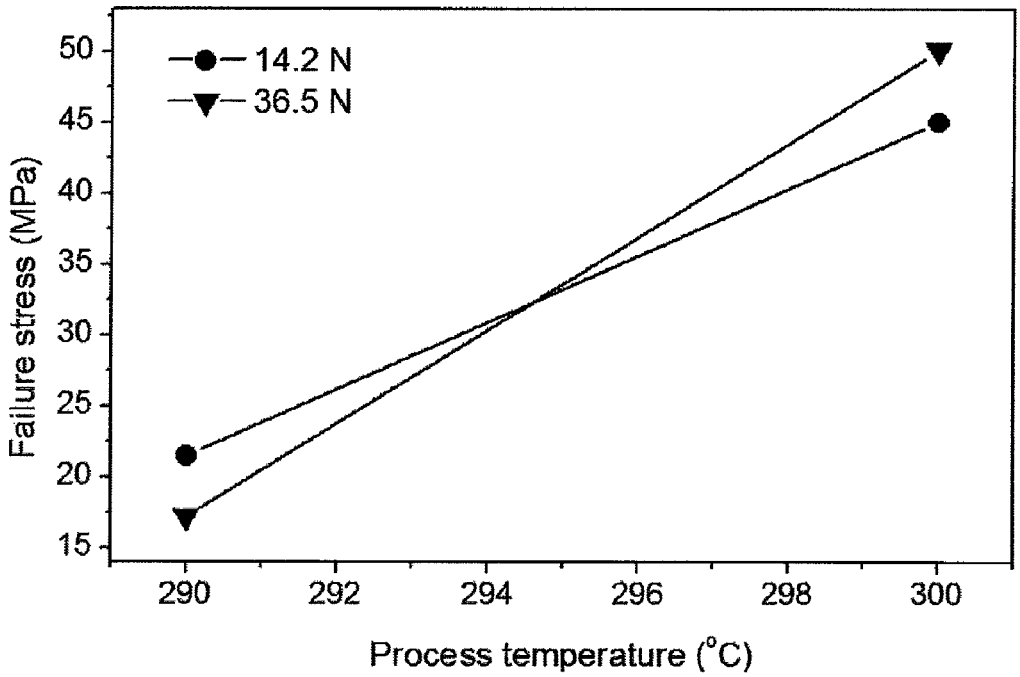
FIG. 12 provides a graph of data from failure stress tests of joints produced by two different load levels.

Three different process loads were used for joining: 5.4, 14.2 and 36.5N, respectively. With the 7.065-mm$^2$ contact area, this correlates to an applied pressure of 0.76, 2.0 and 5.2 MPa. A stable, homogeneous joint was not formed at the lowest load, 5.4N. Thus, it is evident that some process load is necessary for joint formation. However, once the process load exceeds a critical threshold, the effect of process load on joint integrity seems insignificant. Failure stress test of joints generated at process loads of 14.2 and 36.5 N are shown in FIG. 12. The failure stresses of joints formed at 290° C. with 14.2 and 36.5N preload, calculated based on 7.065-mm$^2$ contact area are 21.4 and 17.2 MPa, respectively. Failure stresses for joints formed at 300° C. are 45.0 and 50.1 MPa. It is notable that the bonding strength of ~50 MPa exceeds the ultimate tensile strength of conventional Sn-based solders. (See, e.g., F. Ren, J.-W. Nah, K. N. Tu, B. Xiong, L. Xu and J. H. L. Pang, Appl. Phys. Lett. 89, 141914 (2006); and G. Y. Li, B. L. Chen, X. Q. Shi, S. C. K. Wong and Z. F. Wang, Thin Solid Films 504, 421 (2006), the disclosures of which are incorporated herein by reference.)

Figure 13:
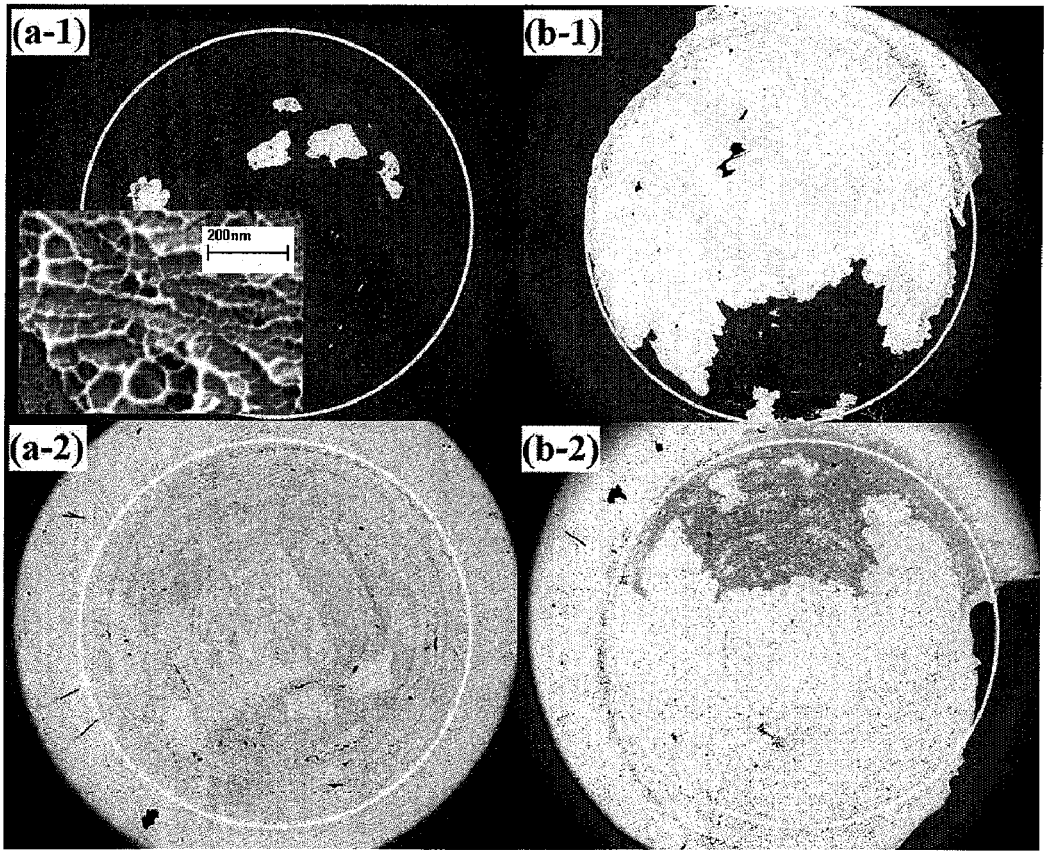
FIG. 13 provides back-scattered images of fracture surfaces of joints produced with 36.5N at (a) 290° C. and (b) 300° C.

The failure surfaces examined using SEM back-scattered images of separated joints processed with 36.5N load are shown in FIG. 13. FIG. 13(*a*-1) and (*a*-2) were formed at 290° C. and FIGS. 13(*b*-1) and (*b*-2) at 300° C. Circles in each micrograph indicate the 3-mm diameter bonding area. By the compositional contrast, copper surface looks dark and platinum based BMG surface looks bright. Comparing the surfaces in FIGS. 13(*a*) and (*b*), it can be seen that the failure mode transitions from interfacial fracture to BMG solder fracture as the process temperature increases. For the joint produced at 290° C., only a small fraction of the contact area has BMG solder residue on the copper surface (FIG. 13(*a*-1)). On the other hand, for the joint processed at 300° C., most of the contact area is covered by BMG solder residue (FIG. 13(*b*-1)), which implies that the interfacial bonding strength of this joint could be higher than 50.1 MPa. High resolution fractography on those BMG solder residues was performed to reveal a typical dimple pattern (the inset in FIG. 13(*a*-1)). This dimple pattern is typical for fracture surfaces of BMGs and confirms that fracture is through the BMG not along the interface. (See, e.g., D. Suh and R. H. Dauskardt, Ann. Chim. Sci. Mat. 27, 25 (2002); and X. K. Xi, D. O. Zhao, M. X. Pan, W. H. Wang, Y. Wu and J. J. Lewandowski, Phys. Rev. Lett. 94, 125510 (2005), the disclosures of which are incorporated herein by reference.) For both joints, the areas with BMG solder residue are thought to have formed an intimate interface between the copper and BMG solder.

The final thickness of the BMG solders range from 50 to 80 μm due to the significant flow under pressure and resultant electrical resistance of the joints are reasonably small ranging from 21 to 27μΩ for the joints formed at 290° C. and from 13 to 15μΩ for 300° C. For the joints formed at 300° C., ideal resistance estimated with 50 μm thick BMG solder is 13.1μΩ based on the resistivity of the platinum based glass, 1850 nΩ.m, indicating that the measured resistance values are close enough to claim the existence of intimate interface. TEM was used to confirm the existence of an intimate interface.

Figure 14:
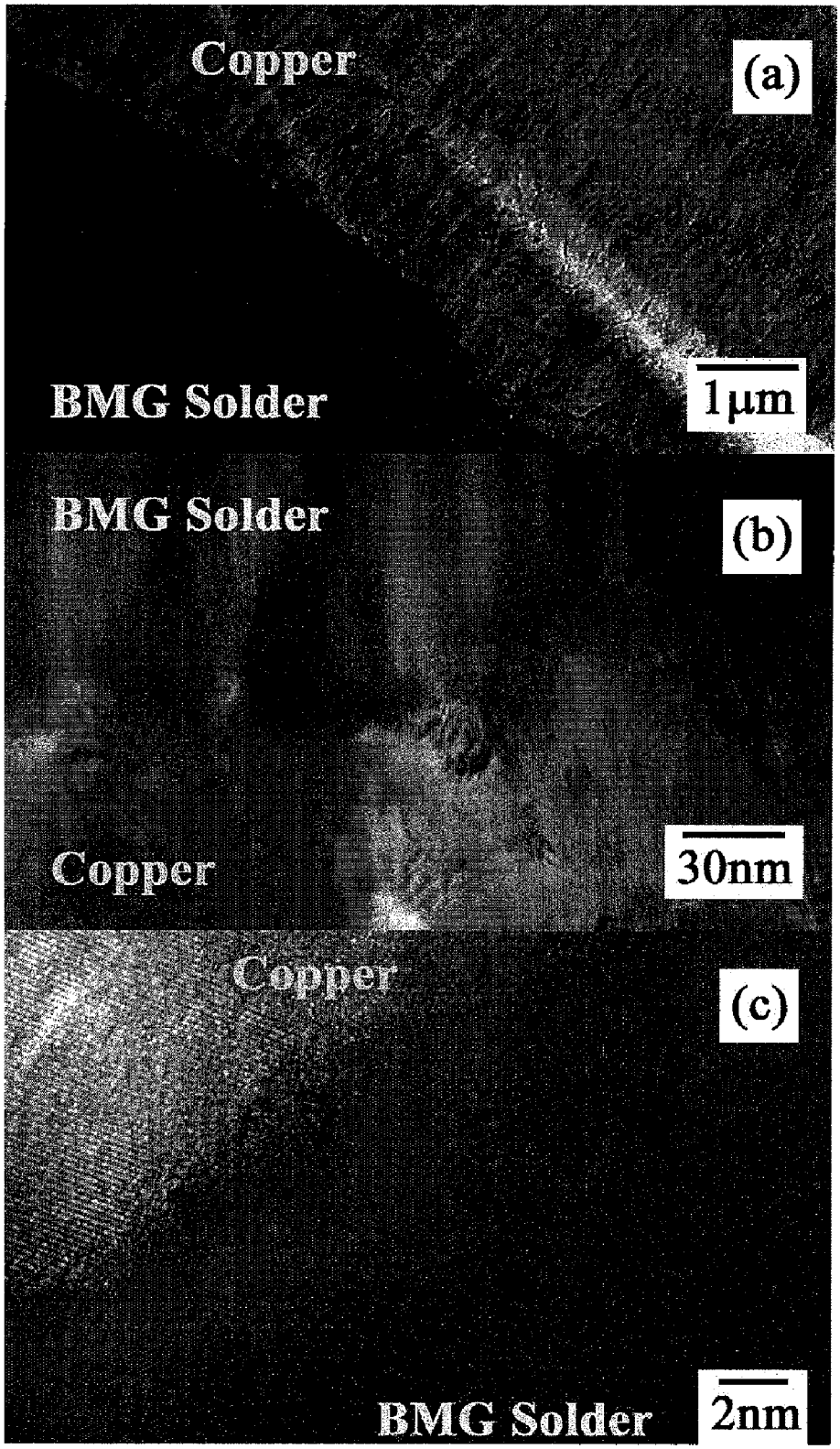
FIG. 14 provides micrographs of the solder-copper interface shown at (a) Low magnification (15,400×), (b) High magnification (523,000×) and (c) High resolution (5,335,000×).

Cross-sectional TEM observation of the interface shown in FIGS. 14(*a*) and (*b*) shows that the BMG solder completely replicates details of the copper surface and forms a void free interface. High resolution imaging of the interface (FIG. 14(*c*)) provides strong evidence that the BMG solder forms an atomistic bond with the copper lattice. It is also noted that no interfacial reaction product is observed along the interface between BMG and copper within the resolution of the TEM employed in this study. This is contrasted with conventional soldering, in which the interface is essentially comprised of IMCs as reaction products. The absence of IMCs in BMG thermoplastic soldering can potentially provide performance benefits in terms of long-term joint reliability because IMCs in the solder joint are known to be a cause of several reliability risks.

SUMMARY

In summary, a novel amorphous joining process has been disclosed and demonstrated using the supercooled liquid region of BMG and the unique rheological properties of these materials to. With assistance of small load, the glassy solder wets a copper surface to form an atomistically-intimate interface. A joint thermoplastically formed between BMG and copper exhibits up to 50 MPa tensile strength. In contrast with conventional soldering the thermoplastically-formed interface shows absence of interfacial reaction products.

Those skilled in the art will appreciate that the foregoing examples and descriptions of various preferred embodiments of the present invention are merely illustrative of the invention as a whole, and that variations in the relative composition of the various components of the present invention may be made within the spirit and scope of the invention. For example, it will be clear to one skilled in the art that typical impurities and/or additives may be included in the compositions discussed above that would not affect the improved properties of the alloys of the current invention nor render the alloys unsuitable for their intended purpose. Accordingly, the present invention is not limited to the specific embodiments described herein but, rather, is defined by the scope of the appended claims.

What is claimed is:

1. A method of forming an at least partially amorphous metallic joint between at least two surfaces comprising:

providing a joining material at an initial temperature, said joining material having the ability to form an amorphous phase when cooled at a rate of 500° C/s or lower;

disposing said joining material on at least one of the surfaces to be joined;

adjusting the temperature of said joining material to a temperature sufficient such that the joining material is able to flow across the at least one surface to be joined;

pressing the at least two surfaces together such that both of the at least two surfaces contact the joining material and such that the joining material is spread across the entire interface between the at least two surfaces; and quenching the joining material to form a metallic joint between the at least two surfaces, wherein the joining material is quenched at a rate sufficient in relation to the crystallization curve of the joining material such that the material passes through a crystallization region of the joining material to ensure the formation of a composite joint formed of a partial amorphous phase and a partial dendritic phase in the solidified joining material.

2. The method of claim 1, further comprising preparing at least one of the at least two surfaces prior to disposing said joining material thereon with a preparatory technique selected from the group consisting of polishing, etching, sand-papering and coating.

3. The method of claim 1, further comprising forming at least one mechanical interlocking feature into the surface of one of the at least two surfaces prior to disposing said joining material thereon.

4. The method of claim 3, wherein the at least one mechanical interlocking feature is in the form of one of a plurality of voids.

5. The method of claim 3, wherein the mechanical interlocking feature is formed at an angle to the surface that is non-perpendicular.

6. The method of claim 1, wherein the joining material is selected from an amorphous alloy selected from the group consisting of noble metal based, lanthanide metal based, aluminum based, late transition metal based, early transition metal based, simple metal based and zirconium metal based.

7. The method of claim 1, wherein the joining material is provided in an amorphous state and at a temperature below the glass transition temperature of the joining material; and wherein the temperature of the joining material is adjusted to a temperature between the glass transition and crystallization temperatures of the joining material prior to pressing the at least two surfaces together.

8. The method of claim 1, wherein the joining material is disposed on the at least one surface in a molten state.

9. The method of claim 1, wherein the quenching rate is adjusted to adjust the level of crystallization of the joining material.

10. The method of claim 1, further comprising reheating the quenched joint to a temperature above the glass transition temperature of the joining materials to adjust the level of crystallization of the joining material.

11. The method of claim 1, further comprising heating the at least one surface to maintain the temperature of the joining material between the glass transition temperature and the crystallization temperature of the joining material.

12. A method of forming an at least partially amorphous metallic joint between at least two surfaces comprising:

providing an amorphous joining material at a temperature below the glass transition temperature of the joining material;

disposing said joining material on at least one of the surfaces to be joined;

heating the joining material to a temperature between the glass transition temperature and the crystallization temperature of the joining material such that the joining material is able to flow across the at least one surface to be joined;

pressing the at least two surfaces together such that both of the at least two surfaces contact the joining material and such that the joining material is spread across the entire interface between the at least two surfaces; and quenching the joining material to below the glass transition temperature of the joining material to form an amorphous metallic joint between the at least two surfaces; and reheating the quenched joint to a temperature in relation to the crystallization curve of the joining material such that the material passes through a crystallization region of the joining material to ensure the formation of a composite joint formed of a partial amorphous phase and a partial dendritic phase in the joining material.

13. The method of claim 12, further comprising preparing at least one of the at least two surfaces prior to disposing said joining material thereon with a preparatory technique selected from the group consisting of polishing, etching, sand-papering and coating.

14. The method of claim 12, further comprising forming at least one mechanical interlocking feature is formed into the surface of one of the at least two surfaces prior to disposing said joining material thereon.

15. The method of claim 14, wherein the at least one mechanical interlocking feature is in the form of a plurality of voids.

16. The method of claim 14, wherein the mechanical interlocking feature is formed at an angle to the surface that is non-perpendicular.

17. The method of claim 12, wherein the joining material is selected from an amorphous alloy selected from the group consisting of noble metal based, lanthanide metal based, aluminum based, late transition metal based, early transition metal based, simple metal based and zirconium metal based.

18. The method of claim 12, wherein the joining material is selected such that the glass transition temperature of the material is less than around 200° C.

19. The method of claim 12, wherein the joining material is provided in the form of one of either balls or strips.

20. A method of forming an at least partially amorphous metallic joint between at least two surfaces comprising:

providing a joining material in a molten form, said joining material having the ability to form an amorphous phase when cooled at a rate of 500° C/s or lower;

disposing said joining material on at least one of the surfaces to be joined;

pressing the at least two surfaces together such that both of the at least two surfaces contact the joining material and such that the joining material is spread across the entire interface between the at least two surfaces; and quenching the joining material to form a metallic joint between the at least two surfaces, wherein the joining material is quenched at a undercooled rate sufficiently fast in relation to the crystallization curve of the joining material such that the material passes through a crystallization region of the joining material to ensure the formation of a composite joint formed of a partial amorphous phase and a partial dendritic phase in the solidified joining material.

21. The method of claim 20, further comprising preparing at least one of the at least two surfaces prior to disposing said joining material thereon with a preparatory technique selected from the group consisting of polishing, etching, sand-papering and coating.

22. The method of claim 20, further comprising forming at least one mechanical interlocking feature into the surface of one of the at least two surfaces prior to disposing said joining material thereon.

23. The method of claim 22, wherein the at least one mechanical interlocking feature is in the form of a plurality of voids.

24. The method of claim 22, wherein the mechanical interlocking feature is formed at an angle to the surface that is non-perpendicular.

25. The method of claim 20, wherein the joining material is selected from an amorphous alloy selected from the group consisting of noble metal based, lanthanide metal based, aluminum based, late transition metal based, early transition metal based, simple metal based and zirconium metal based.

* * * * *